US005623333A

United States Patent [19]

Nagase et al.

[11] Patent Number: 5,623,333

[45] Date of Patent: Apr. 22, 1997

[54] IMAGE FORMING APPARATUS HAVING A SEPARATION MECHANISM BETWEEN IMAGE BEARING MEMBER AND TRANSFER MEMBER BEARING MEMBER

[75] Inventors: Toshiki Nagase, Hoya; Akira Ito, Tokyo, both of Japan

[73] Assignee: Canon Kabushiki Kaisha, Tokyo, Japan

[21] Appl. No.: 491,802

[22] Filed: Jun. 19, 1995

Related U.S. Application Data

[63] Continuation of Ser. No. 80,500, Jun. 24, 1993, abandoned.

[30] Foreign Application Priority Data

Jun. 29, 1992 [JP] Japan ..... 4-194750

[51] Int. Cl.[6] ..... G03G 21/00; G03G 15/00

[52] U.S. Cl. ..... 399/381; 399/45; 399/68

[58] Field of Search ..... 355/208, 271, 355/273, 282, 285, 290, 308, 309, 315, 326 R, 327

[56] References Cited

U.S. PATENT DOCUMENTS

| | | | |
|---|---|---|---|
| 4,593,992 | 6/1986 | Yoshinaga et al. | 355/290 X |
| 4,719,489 | 1/1988 | Ohkubo et al. | 355/290 |
| 4,887,101 | 12/1989 | Hirose et al. | 355/327 X |
| 4,905,048 | 2/1990 | Suzuki | 355/271 |
| 5,138,392 | 8/1992 | Kinoshita et al. | 355/289 |

FOREIGN PATENT DOCUMENTS

| | | |
|---|---|---|
| 0281055 | 9/1988 | European Pat. Off. . |
| 4113560 | 10/1991 | Germany . |
| 5-289467 | 11/1993 | Japan . |

*Primary Examiner*—Sandra L. Brase

*Attorney, Agent, or Firm*—Fitzpatrick, Cella, Harper & Scinto

[57] ABSTRACT

An image forming apparatus having means for separating a transfer medium bearing member from an image bearing member, which can change fixing speed according to the kinds of the transfer medium employed. As the transfer medium is borne and conveyed to a fixing device by the transfer medium baring member which is separated from the image bearing member, the unfixed toner images are not disturbed by or re-transferred onto the image bearing member and a long conveyed belt is not needed. When the same drive source rotates the transfer medium bearing member and the image bearing member, the apparatus can be further miniaturized.

23 Claims, 21 Drawing Sheets

IMAGE FORMING APPARATUS HAVING A SEPARATION MECHANISM BETWEEN IMAGE BEARING MEMBER AND TRANSFER MEMBER BEARING MEMBER

This application is a continuation, of application Ser. No. 08/080,500 filed Jun. 24, 1993, now abandoned.

BACKGROUND OF THE INVENTION

1. Field of the Invention

The present invention relates to an image forming apparatus employing electrophotography-processes, electrostatic recording processes, or the like, which can be preferably applied to a color copying machine, a color laser printer, and so on.

2. Related Background Art

Various kinds of color image forming apparatus employing electrophotography processes, electrostatic recording processes, or the like have been devised and put to practical use. FIG. 9 shows an example of the color laser printer which repeats a rotation transfer process several times to obtain a multicolor image.

The color laser printer of this embodiment has a photosensitive drum (image bearing member) 1 on which a latent image is formed and which can rotate in the direction indicated by the arrow in the FIG. 9. Around the periphery of the photosensitive drum 1, a primary charger device 2, a laser exposure device 3 for forming the latent image on the photosensitive drum 1, a developer device 4 having a plurality of developers 4Y, 4M, 4C and 4B for converting the latent image formed on the photosensitive drum 1 into a visible image (toner image), and a transfer drum 5 for transferring the toner image on the photosensitive drum 1 onto a transfer medium P are arranged.

The transfer medium (sheet) is separated from a sheet feed unit one by one by a sheet feed roller 6, and sent to the transfer drum 5 by regist rollers 7 at constant timing. The transfer drum has a nipping means 14 such as a gripper for nipping the front end of the transfer medium P fed to the transfer drum 5. The transfer medium P is electrostatically attracted onto the surface of the transfer drum 5 by an attracting roller 13 to be further conveyed. The transfer medium P supported and conveyed by the transfer drum 5 passes between the transfer drum 5 and the photosensitive drum 1 (transfer position), where the toner image formed on the photosensitive drum 1 is transferred. After this transfer process is repeated several times, the transfer medium P is separated from the transfer drum 5 by a separation claw 15 and conveyed to a fixing device 8 by a convey belt 16. The fixing device 8 fixes each color toner image into a permanent image to obtain a multicolor image.

In the above-mentioned conventional apparatus, when a transparent resin sheet such as an OHP sheet is used as the transfer medium P, the OHP sheet separated from the transfer drum 5 is also conveyed to the fixing device 8 by the convey belt 16. In order to ensure melting of toner on the transfer medium and prevent fixing failure, however, fixing takes about twice as long time as a normal sheet of about 100 g. For, heat capacity of a normal sheet and that of an OHP sheet much differ from each other, and the OHP sheet needs several times as much quantity of heat as the normal sheet of the same thickness to obtain practical transparency.

In order to solve this problem, fixing speed of the fixing device 8 must be made less than ½ of the peripheral speed of the transfer drum 5 when the OHP sheet is conveyed.

Accordingly, conveying speed of the convey belt 16 is set to be substantially equal to the peripheral speed of the transfer drum 5 until the rear end of the OHP sheet separates from the transfer position, but after separation, the conveying speed is decelerated to be less than ½ of the peripheral speed of the transfer drum 5.

On the other hand, when the transfer medium P is a normal sheet of about 100 g, the peripheral speed of the transfer drum 5 and the conveying speed of the convey belt 16 are set to be substantially equal to the speed at which the transfer medium passes through the fixing device.

Thus, the convey belt 16 effectively adjusts the transfer medium conveying speed according to the time required for fixing different kinds of transfer media P. However, it is necessary to make the transfer sheet conveying path between the transfer position and the fixing position longer than the maximum length of the transfer sheet employed. Therefore, the convey belt 16 must be rather long, which is problematic in miniaturizing the apparatus main body.

SUMMARY OF THE INVENTION

An object of the present invention is to provide an image forming apparatus capable of excellent fixation regardless of the types of transfer media.

Another object of the present invention is to provide a small-size image forming apparatus in which the distance between the transfer position and the fixing position is reduced.

Still another object of the present invention is to provide an image forming apparatus capable of excellent image formation even when a resin sheet is used as the transfer medium.

Further objects and characteristics of the present invention will be more clearly understood from the following description referring to the accompanied drawings.

DETAILED DESCRIPTION OF THE PREFERRED EMBODIMENTS

The image forming apparatus according to the present invention will be further described below in detail with reference to the drawings.

EMBODIMENT 1

Figure 1:
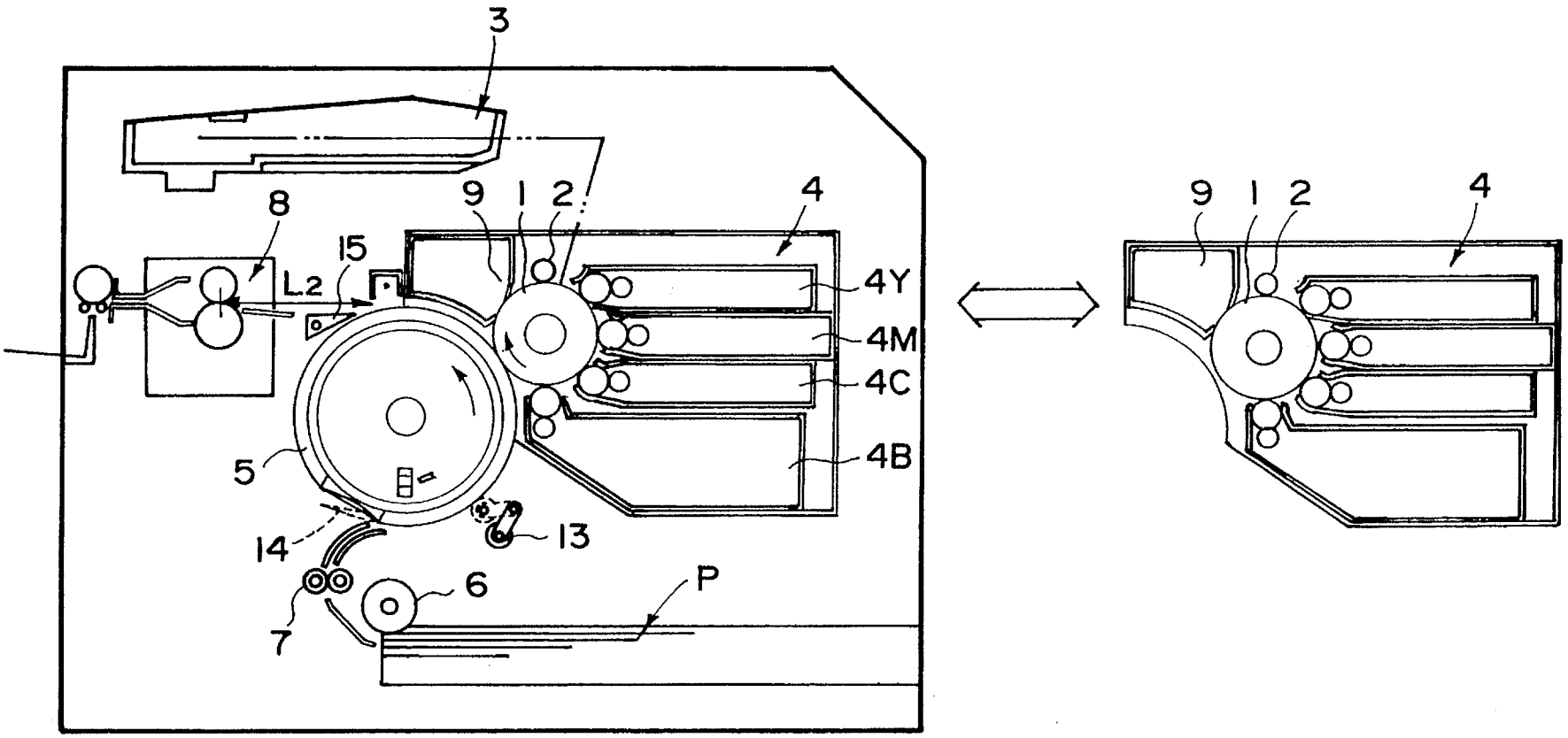
FIG. 1 is a schematic block diagram of an electrophotography type color laser printer to which the color image forming apparatus of the present invention can be applied.

FIG. 1 shows the first embodiment of the color image forming apparatus according to the present invention which is applied to a color laser printer employing the electrophotography process. In this embodiment, the color laser printer has a photosensitive drum (image bearing member) 1 on which a latent image is formed and which can rotate as indicated by an arrow in the FIG. 1. Around the periphery of the photosensitive drum 1, a primary charger device 2, a laser exposure device 3 for forming the latent image on the photosensitive drum 1, a developer device 4 having a plurality of developers: a yellow developer 4Y, a magenta developer 4M, a cyan developer 4C and a black developer 4B, for converting the latent image formed on the photosensitive drum 1 into a visible image (toner image), a transfer drum 5 for transferring the toner images on the photosensitive drum 1 onto a transfer medium (normal sheet) P, and a cleaning device 9 for removing toner left on the photosensitive drum 1 are provided. The photosensitive drum 1, and the primary charger device 2, the developer device 4, the cleaning device 9, and so on provided in the vicinity of the photosensitive drum 1 integrally constitute a process cartridge which is detachably mounted on the apparatus main body.

In a normal sheet mode, a transfer medium P is separated one by one from a sheet feed unit by a sheet feed roller 6, and sent to the transfer drum 5 at constant timing by resist roller 7. The transfer drum 5 has a nipping means 14 such as a gripper for nipping the front end of the transfer medium P conveyed to the transfer drum 5. The transfer medium P is electrostatically attracted onto the surface of the transfer drum 5 by an attracting roller 13 to be further conveyed. The transfer medium P supported and conveyed by the transfer drum 5 passes between the transfer drum 5 and the photosensitive drum 1 (transfer position), where, at first, the yellow toner image formed on the photosensitive drum 1 is transferred. Toner left on the photosensitive drum 1 is removed by the cleaning device 9, and the photosensitive drum 1 is ready for the next image formation process. Then, when the front end of the transfer medium again reaches the transfer position by rotation of the transfer drum 5, the magenta toner image is transferred onto the transfer medium P. Similarly, the cyan toner image and the black toner image are superimposed on the transfer medium P by repeating the transfer process. After finishing transfer of toner images, the transfer medium P is separated from the transfer drum 5 by a separation claw 15, and conveyed to the fixing device 8, where respective color toner image are melted and mixed to be a fixed permanent image, that is, a multicolor image.

Next, an OHP sheet mode in which an OHP sheet is used as the transfer medium P will be described. In this mode, operation until the fourth toner image, that is, black toner image in this embodiment, is transferred is the same as in the normal sheet mode. After finishing the transfer processes, the OHP sheet is not separated from the transfer drum 5, but is shifted while supported on the transfer drum 5. Then, when the rear end of the OHP sheet passes through the transfer position, the rotating transfer drum 5 is separated from the photosensitive drum.

Thus, after the transfer drum 5 separates from the photosensitive drum 1 so that the OHP sheet does not come into contact with the photosensitive drum at the transfer position, the OHP sheet passes between the drums 5 and 1. Accordingly, the toner images on the OHP sheet are not transferred onto the photosensitive drum 1. Subsequently, the OHP sheet is separated from the transfer drum 5 by the separation claw and respective color toner images are fixed by the fixing device to obtain a multicolor image as a permanent image.

At this time, the peripheral velocity of the transfer drum 5 is decelerated to about ½ thereof just before the front end of the OHP sheet reaches the fixing device 8. The speed of the OHP sheet passing through the fixing device is set to be about ½ of the peripheral speed of the transfer drum 5 during the transfer process (which is the same speed in the normal sheet mode). That is, in this case, the peripheral velocity of the transfer drum is substantially equal to the conveying speed of the fixing device, both of which are about ½ of the speed in the normal sheet mode. Since the peripheral velocity of the transfer drum is equal to the conveying speed of the fixing device, the images are not disturbed when the OHP sheet comes into the fixing device. Note that, as the transfer drum with the OHP sheet supported thereon can be decelerated, the distance L2 from the separation position to the fixing position can be shorter than the maximum length, in the conveying direction, of the OHP sheet.

Now, the drive means for the transfer drum 5 which separates the transfer drum 5 from the photosensitive drum 1 will be described with reference to FIGS. 2 and 3.

In this embodiment, a motor 17 for driving the transfer drum 5 and the photosensitive drum 1 has a gear 18 around its rotation axis. The gear 18 engages with a large gear 19*a* of a double gear 19, while a small gear 19*b* of the double gear 19 engages with gears 20 and 22. The gear 22 is attached to a flange portion of the photosensitive drum 1 and rotates with the photosensitive drum 1. On the other hand, the gear 20, which is attached to a flange portion of the transfer drum 5, engages with a gear 21 which rotates with the transfer drum 5.

The gear 20 is rotatably set around a shaft 20*a* which is caulked in an end of a rotary plate 24, the other end of which is rotatably set around a rotation axis 19*c* of the double gear 19. Further, the rotary plate 24 is given torque around the rotation axis 19*c* (clockwise in FIG. 2) by a torsion coil spring 25, that is, the gear is constantly pressed toward the gear 21. The torsion coil spring 25 is set around the shaft 19*c* and its one arm is set on a pin 26 and the other on the rotary plate 24.

Figure 3:
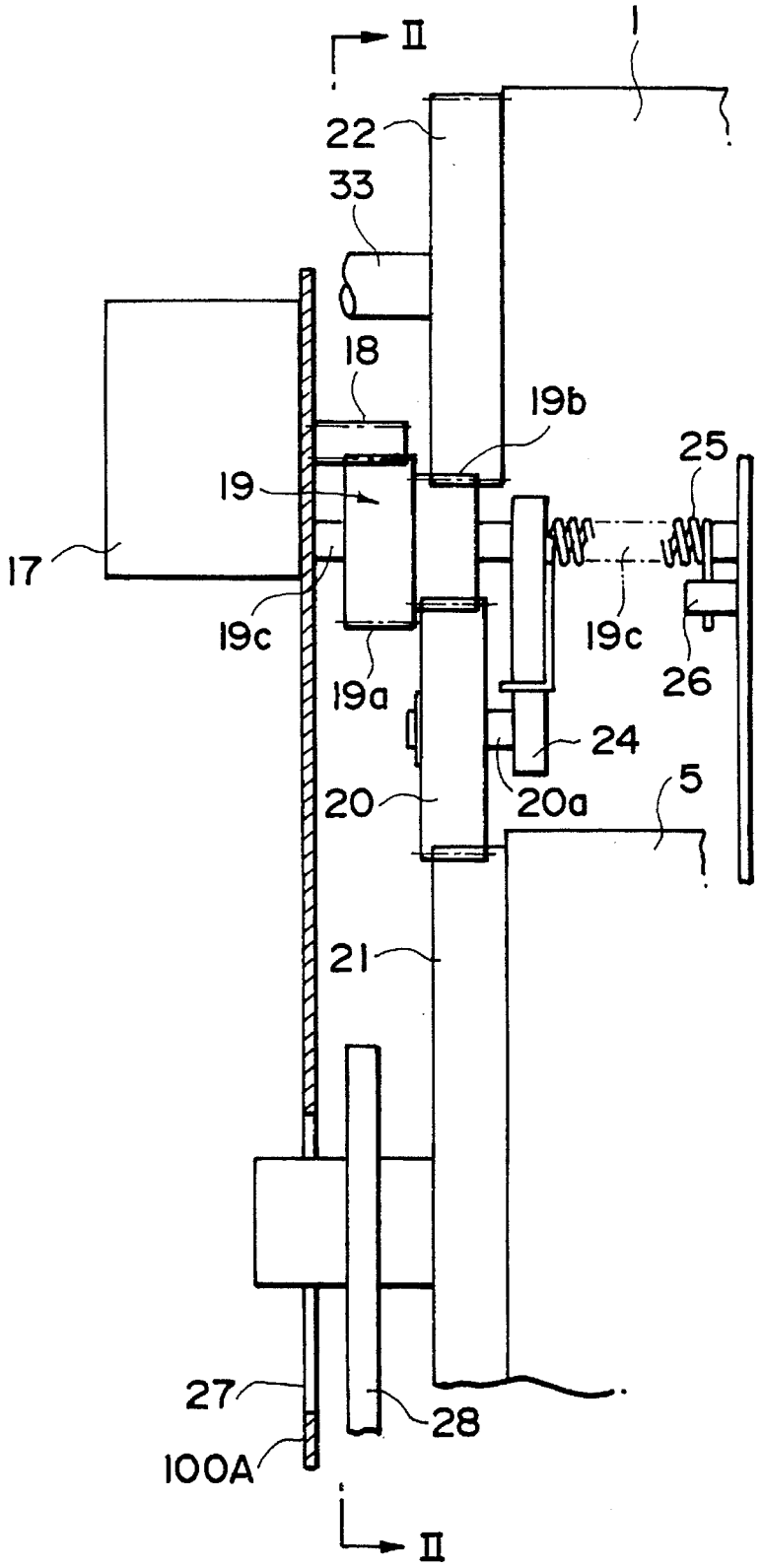
FIG. 3 is a partial front view of the drive means and the separation means for the transfer drum and the photosensitive drum shown in FIG. 2.

Furthermore, a rotation axis 32 of the transfer drum 5 is positioned by side plates 100: 100A and 100B (of which the side plate 100B is not shown in FIG. 3). The side plates 100 have slits 27 into which the ends of the rotation axis 32 are put. The longitudinal direction of these slits 27 coincides with that from a rotation axis 33 of the photosensitive drum 1 to the rotation axis 32 of the transfer drum 5 so that the rotation axis 32 of the transfer drum 5 shifts in the slits 27 to position the transfer drum 5 at a predetermined position. The rotation axis 32 is pressed against an eccentric cam 30 by a keep plate 28. The keep plate 28 rotates around a shaft 29 and is pressed by a spring 31 so as to come into contact with the rotation axis 32. Therefore, the amount of rotation of the eccentric cam 30 determines the shifting amount of the transfer drum 5.

In the above-mentioned construction, torque of the motor 17 is transmitted via the gears 18, 19 (19*a* and 19*b*) and 22 to rotate the photosensitive drum 1. At the same time, torque of the motor 17 is transmitted via the gears 18, 19 (19*a* and 19*b*), 20 and 21 to rotate the transfer drum 5.

Figure 4:
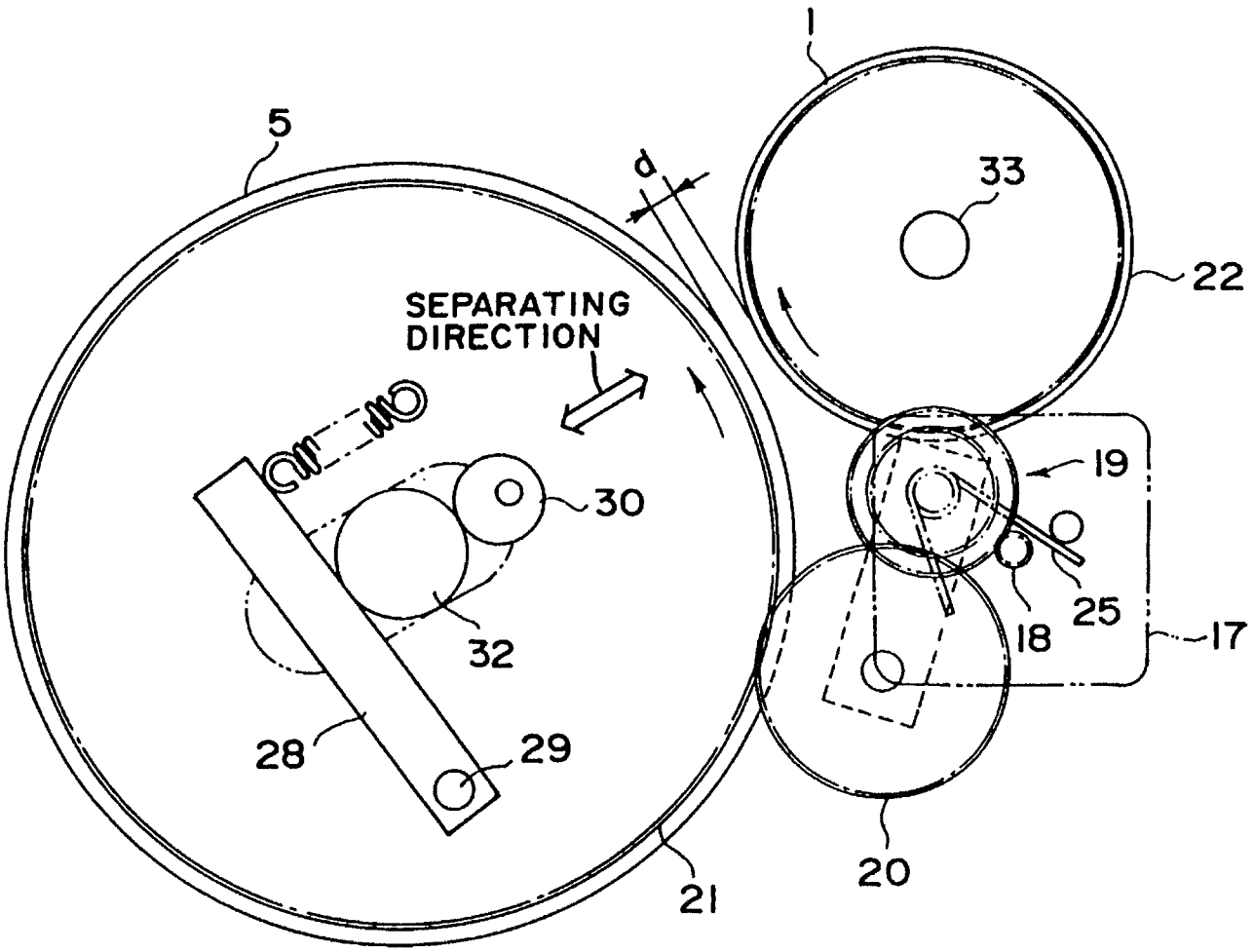
FIG. 4 is a side view of the drive means and the separation means for the transfer drum and the photosensitive drum shown in FIG. 2, thereby showing a state in which the transfer drum separates from the photosensitive drum.

Furthermore, as shown in FIG. 4, even when the eccentric cam 30 is rotated by a driving source (not shown) and the transfer drum 5 is separated from the photosensitive drum 1, the gear 20 remains engaged with the gear 21 by the torsion coil spring 25, thereby always rotating the transfer drum 5. FIG. 4 shows a state where the transfer drum 5 is separated from the photosensitive drum 1, wherein, in this embodiment, the separation distance d is set to be 4 mm. Incidentally, by employing a stepping motor as the motor 17, the peripheral velocity of the transfer drum 5 can be decelerated by softly varying the pulse speed.

EMBODIMENT 2

Figure 5:
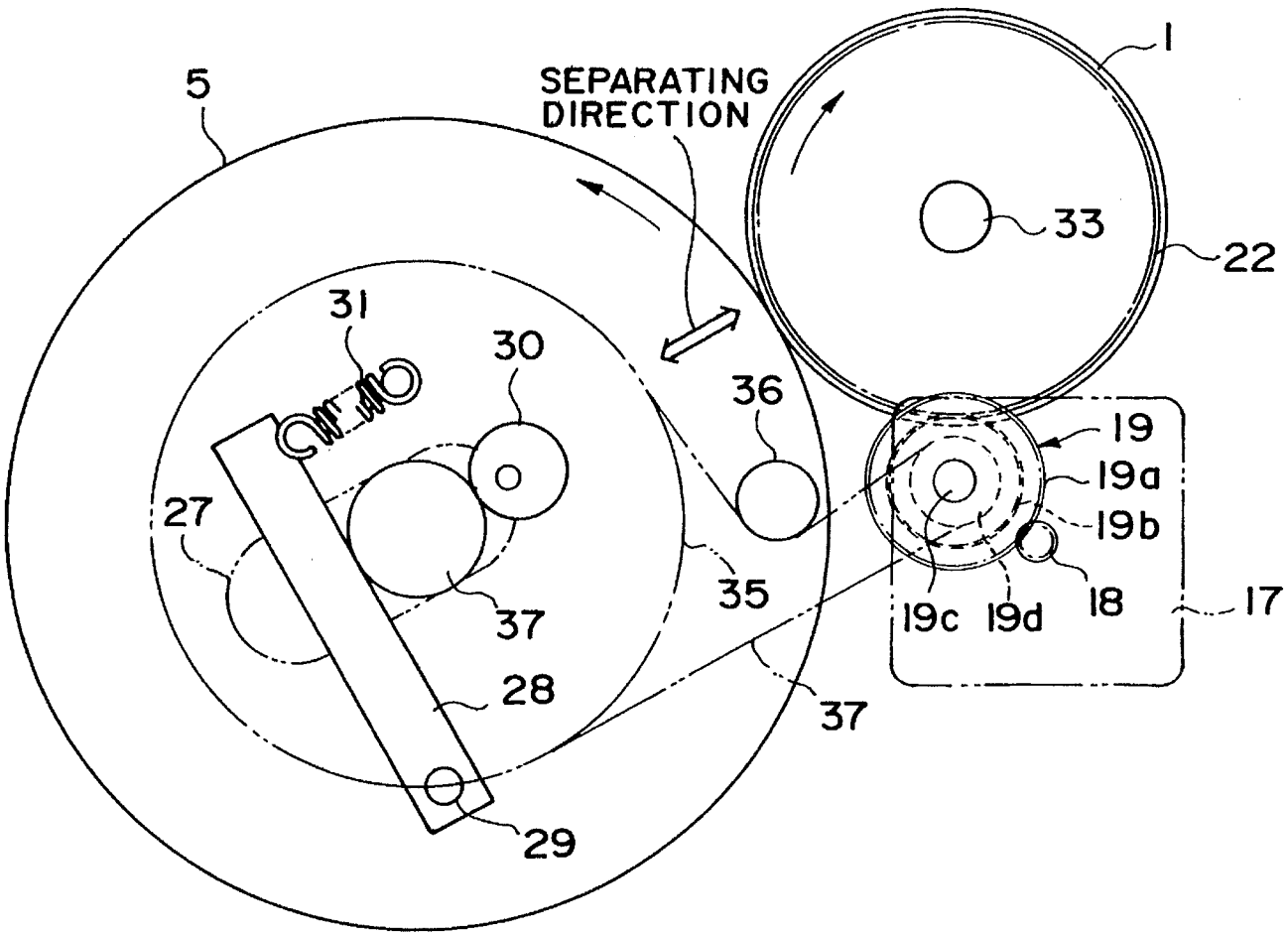
FIG. 5 is a side view of a part (indicated by V—V in FIG. 6) of the second embodiment of the color image formation apparatus according to the present invention, thereby showing a drive means and a separation means for the transfer drum and the photosensitive drum.
Figure 6:
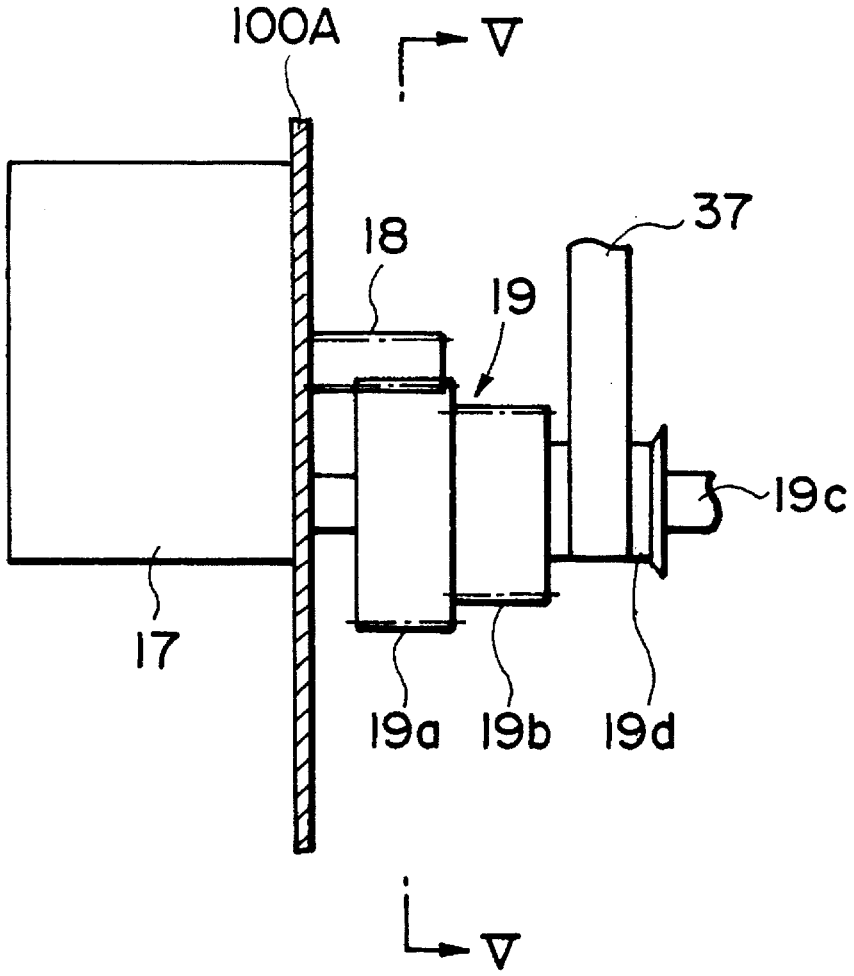
FIG. 6 is a partial front view of the drive means and the separation means for the transfer drum and the photosensitive drum shown in FIG. 5.

FIGS. 5 and 6 show the second embodiment of the present invention. In this embodiment, the color image forming apparatus according to the present invention is applied to the same color laser printer as in Embodiment 1, which differs from Embodiment 1 only in the drive means for the transfer drum 5 which separates the transfer drum 5 from the photosensitive drum 1. Therefore, only the drive means will be described below.

In this embodiment, the gear 18 set around the rotation axis of the drive motor 17 for the transfer drum 5 and the photosensitive drum 1 engages with the large gear 19*a* of the double gear 19, while the small gear 19*b* of the double gear 19 engages the gear 22 set around the flange portion of the photosensitive drum 1. Further, the double gear 19 has a small pulley 19*d* which is integrally and coaxially formed. A timing belt 37 is stretched between the small pulley 19*d* and a large pulley 35 which is set around the flange portion of the transfer drum 5 and rotates integrally therewith. A tension pulley 36 gives appropriate tension to the belt 37.

Therefore, in this embodiment, driving torque of the drive motor 17 is transmitted via the gears 18, 19 (19*a* and 19*b*) and 22 to the photosensitive drum 1, as well as via the small pulley 19*d*, the timing belt 37 and the large pulley 35 to the transfer drum 5, thereby rotating the photosensitive drum 1 and the transfer drum 5.

Even when the eccentric cam 30 is rotated by a driving source (not shown) and the transfer drum 5 is separated from the photosensitive drum 1, the transfer drum 5 is kept rotating by means of the small pulley 19*d*, the large pulley 35 and the timing belt 37.

In the embodiment shown in FIG. 5, the transfer drum 5 is separated from the position of its rotation axis in the contact state toward the direction opposite to the rotation axis 33 of the photosensitive drum 1. But the present invention is not limited thereto, and by rotating the transfer drum 5 by the pulleys 19*d*, 35 and the timing belt 37, large tolerance can be given in choosing the separating direction of the transfer drum 5 from the photosensitive drum.

EMBODIMENT 3

Figure 7:
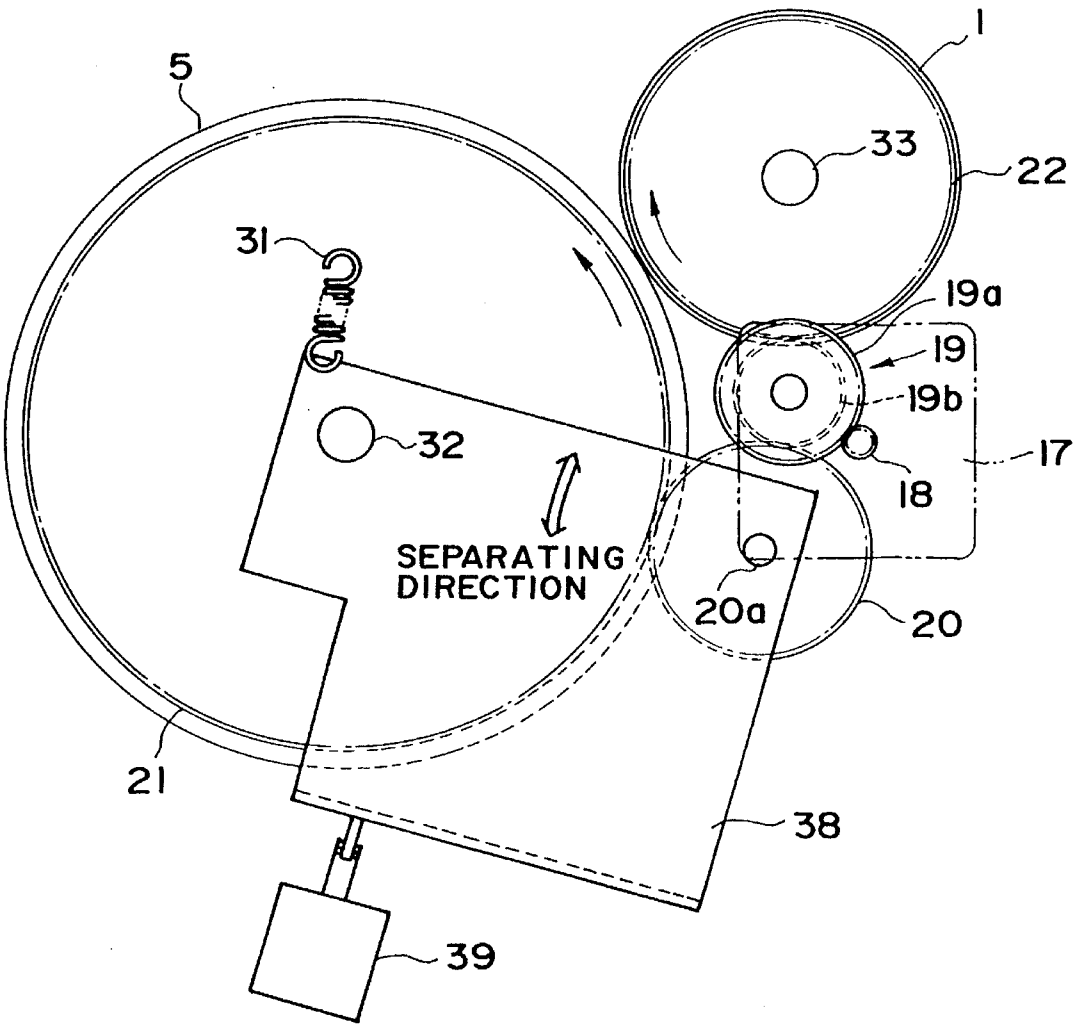
FIG. 7 is a side view of a part (indicated by VII—VII in FIG. 8) of the third embodiment of the color image forming apparatus according to the present invention, thereby showing a drive means and a separation means of the transfer drum and the photosensitive drum.
Figure 8:
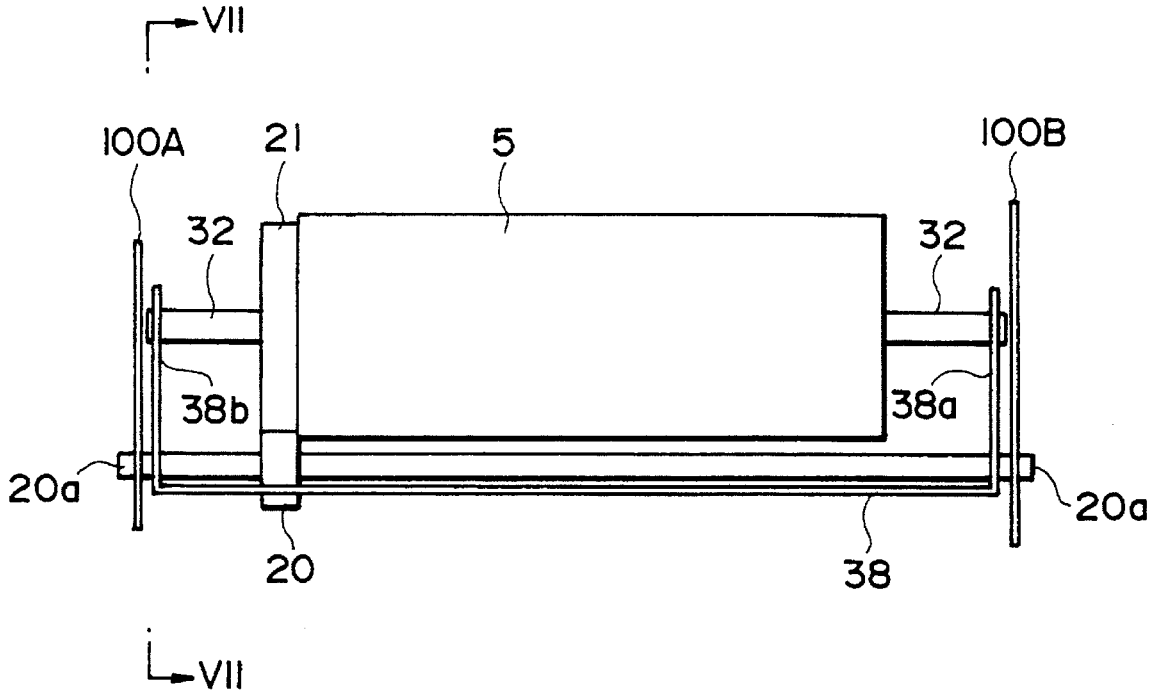
FIG. 8 is a front view of the drive means and the separation means for the transfer drum and the photosensitive drum shown in FIG. 7.

FIGS. 7 and 8 show the third embodiment of the present invention. In this embodiment, the color image forming apparatus according to the present invention is applied to the same color laser printer as in Embodiment 1, wherein the drive means for the transfer drum 5 and the photosensitive drum 1 which separates the transfer drum 5 from the photosensitive drum 1 has the same construction. The separation means, however, much differs from that in Embodiment 1. Accordingly, the difference will be described below.

In this embodiment, the rotation axis of the motor 17 for driving the transfer drum 5 and the photosensitive drum 1 has a gear 18 which engages with the large gear 19*a* of the double gear 18. The small gear 19*b* of the double gear 19 engages with the gears 20 and 22. The gear 22 which is set around the flange portion of the photosensitive drum 1 rotates with the photosensitive drum 1. On the other hand, the gear 20 engages with the gear 21 which is set around the flange portion of the transfer drum 5 and rotates therewith.

In this embodiment, as shown in FIG. 8, the gear 20 differs from that of Embodiment 1 in that it is rotatably set around the spindle 20*a* which is fixedly provided to the side plates 100A and 100B. Further, a rotary arm 38 is rotatably provided around said spindle 20*a*. The rotary arm 38 has, as a whole, U-like shape. As clear from FIG. 8, the rotation axis 32 of the transfer drum 5 is rotatably attached to both side plate portions of the rotary arm 38, wherein the distance, which is determined by the rotary arm 38, between the rotation axis 32 of the transfer drum 5 and the spindle 20*a* is designed so that the gear 20 and the gear 21 engage with each other. Further, the rotary arm 32 is pressed clockwise around the spindle 20*a* by the spring 31 as shown in FIG. 7 and the surface of the transfer drum 5 is kept in contact with the surface of the photosensitive drum 1. Rotation of the rotary arm 32 around the spindle 20*a* is controlled by turning on/off a solenoid 39 so that the transfer drum can separate from and come into contact with the photosensitive drum 1.

In the above construction, torque of the drive motor 17 is transmitted via the gears 18, 19 (19*a* and 19*b*) and 22 to the photosensitive drum 1, as well as via the gears 18, 19 (19*a* and 19*b*), 20 and 21 to the transfer drum, thereby rotating the photosensitive drum 1 and the transfer drum 5. Rotation of the rotary arm 32 is controlled by turning on/off the solenoid 39 so that the transfer drum 5 is rotated around the rotation axis 20*a* of the gear 20 even when the transfer drum 5 is separated from the photosensitive drum 1. As a result, the gear 20 and the gear 21 always engage with each other and the transfer drum 5 is constantly rotated.

EMBODIMENT 4

FIGS. 10 to 13 show the fourth embodiment of the present invention. In this embodiment, the color image forming apparatus according to the present invention is applied to the same color laser printer as in Embodiment 1, wherein only the separation means for the transfer drum 5 which separates the transfer drum 5 from the photosensitive drum 1 differs from that of Embodiment 1. Therefore, only the separation means will be described below.

Figure 10:
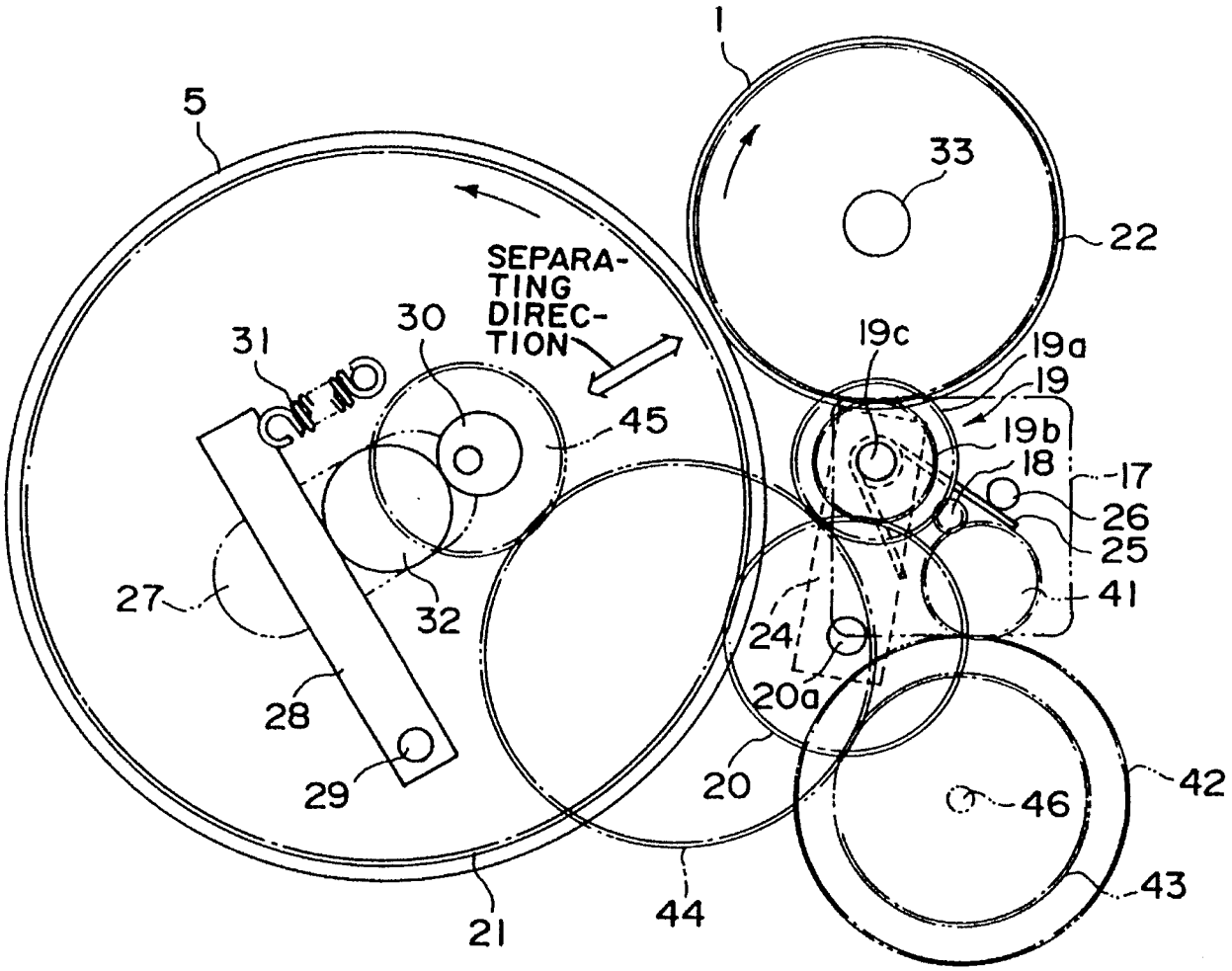
FIG. 10 is a side view of a drive means and a separation means for the transfer drum and the photosensitive drum in the fourth embodiment of the color image forming apparatus according to the present invention, wherein the drive means is indicated by solid lines and the separation means is indicated by dashed lines.
Figure 11:
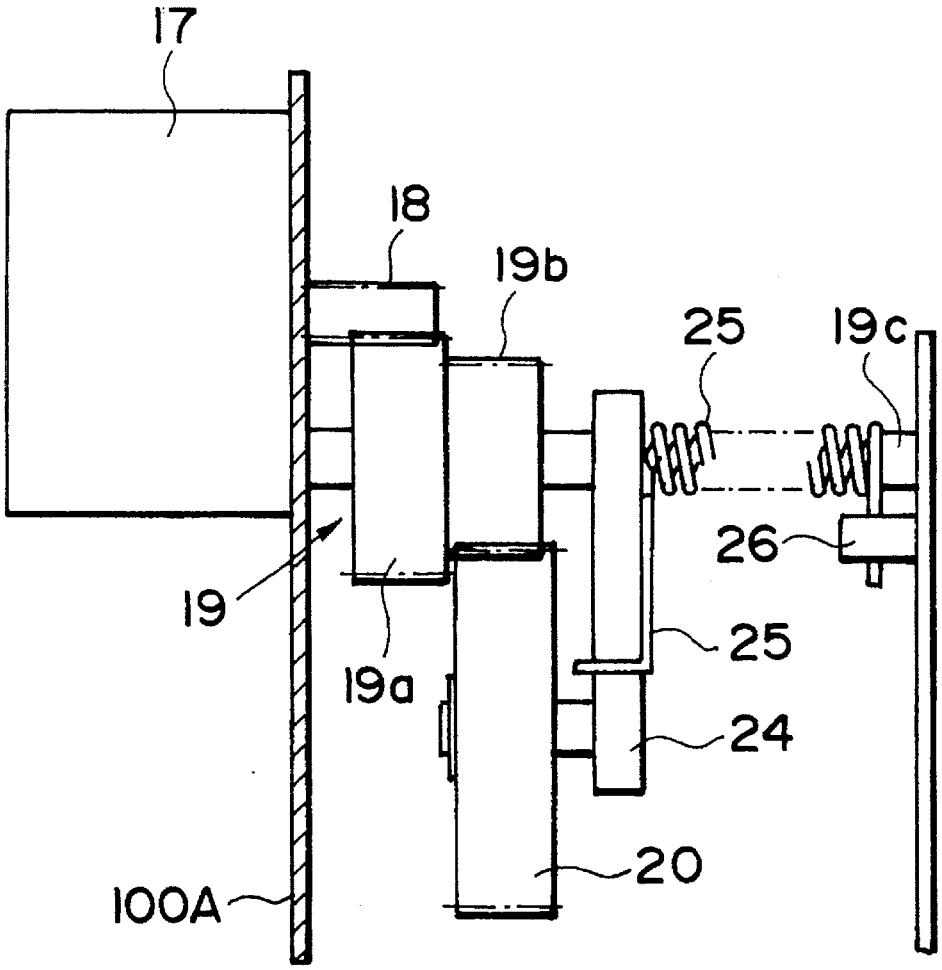
FIG. 11 is a partial front view of the drive means and the separation means for the transfer drum and the photosensitive drum shown in FIG. 10.

In this embodiment, referring to FIGS. 10 and 11, the rotation axis of the motor 17 for driving the transfer drum 5 and the photosensitive drum 1 has the gear 18, which engages with the large gear 19*a* of the double gear 19. The small gear 19*b* of the double gear 19 engages with the gears 20 and 22. At this time, the gear 22 is set around the flange portion of the photosensitive drum 1 and rotates with the photosensitive drum 1. On the other hand, the gear 20 engages with the gear 21 which is set around the flange portion of the transfer drum 5 and rotates therewith.

Further, the gear 20 is rotatably set around the shaft 20*a* which is caulked to one end of the rotary plate 24, the other end of which is rotatably set around the rotation axis 19*c* of the double gear 19. Furthermore, clockwise torque is given to the rotary plate 24 by the torsion coil spring 25 as shown in FIG. 10 so that the gear 20 is constantly pressed toward the gear 21. The torsion coil spring 25 set around the shaft 19*c*, and have its one arm set on the pin 26 and the other on the rotary plate 24.

Furthermore, the rotation axis 32 of the transfer drum 5 is positioned by the side plates 100: 100A and 100B (also see FIG. 13). the side plates 100 have slit 27 into which the ends of the rotation axis 32 are put. The longitudinal direction of the slits 27 coincides with that from the rotation axis 33 of the photosensitive drum 1 to the rotation axis 32 of the transfer drum 5 so that the rotation axis 32 of the transfer drum 5 shifts in the slits to position the transfer drum 5 at a predetermined position. The rotation axis 32 is pressed against the eccentric cam 30 by the keep plate 28. The keep plate 28 rotates around the shaft 29 and is pressed by the spring 31 so as to come into contact with the rotation axis 32. Therefore, the amount of rotation of the eccentric cam 30 determines the shifting amount of the transfer drum 5.

Figure 2:
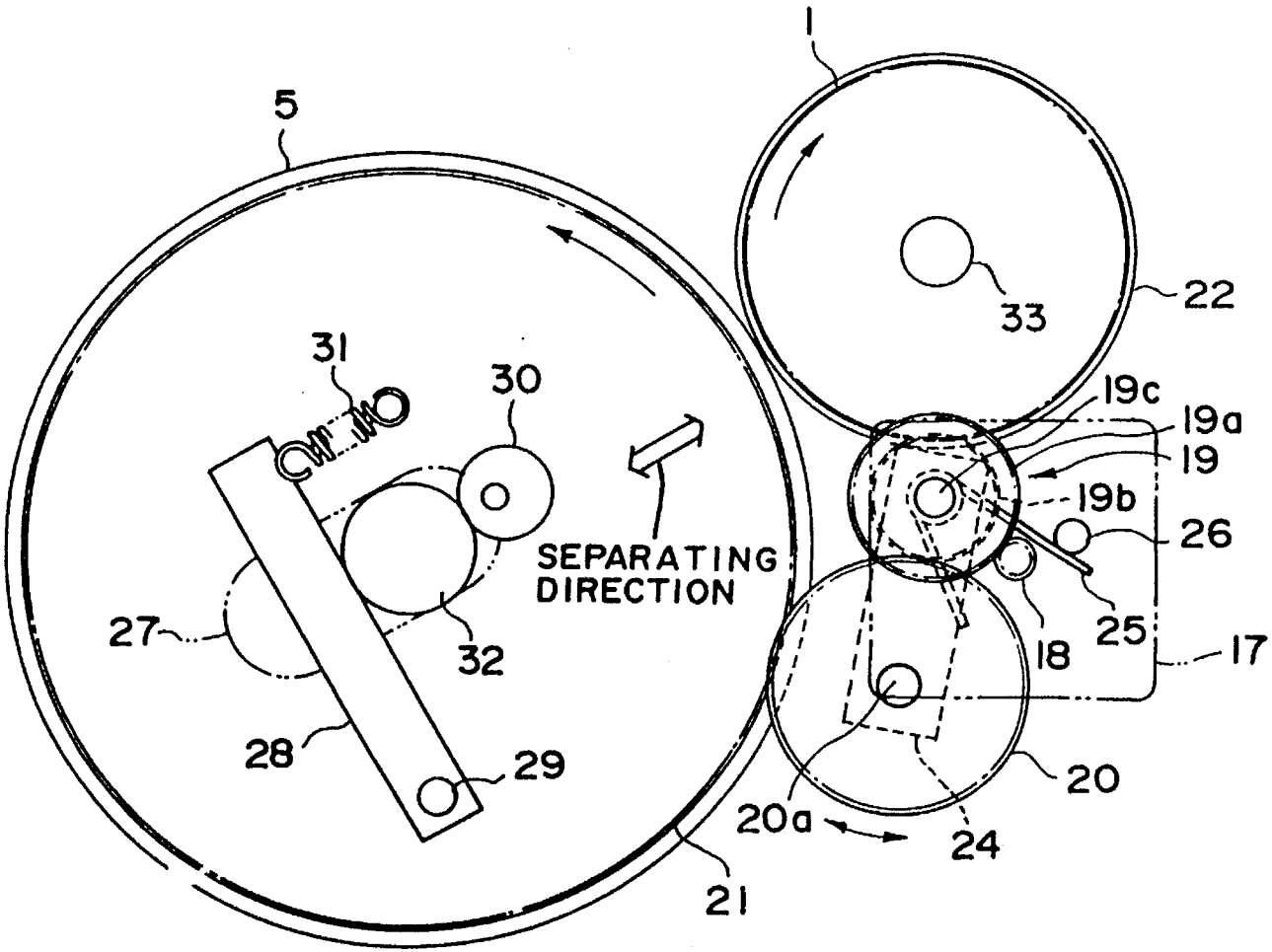
FIG. 2 is a side view of a part (indicated by II—II in FIG. 3) of the first embodiment of the color image formation apparatus according to the present invention, thereby showing a drive means and a separation means for a transfer drum and a photosensitive drum.

As described above, the above-mentioned drive means for the transfer drum 5 and the photosensitive drum 1 has the same construction as that of embodiment 1 shown in FIG. 2.

Figure 12:
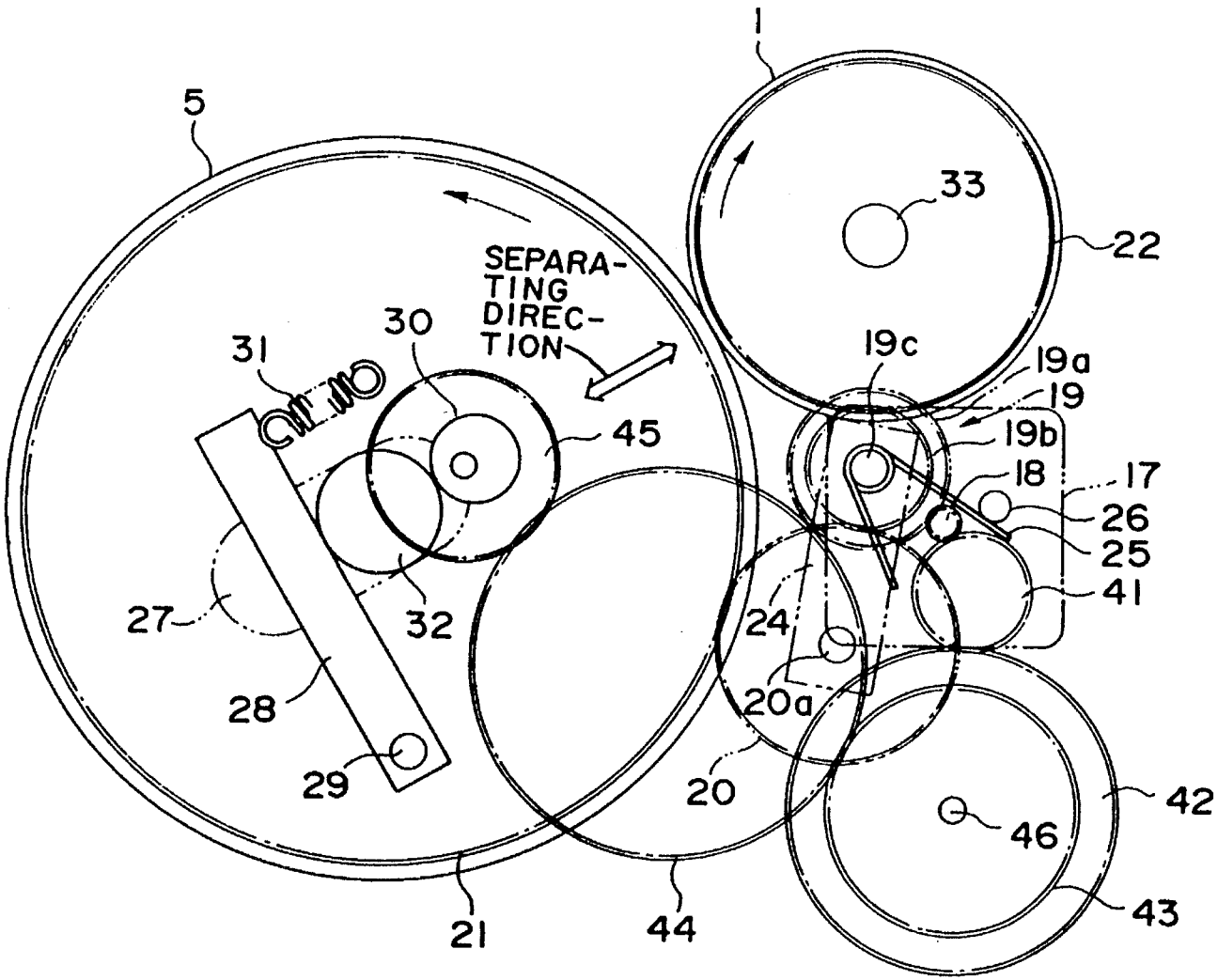
FIG. 12 is a side view of the drive means and the separation means for the transfer drum and the photosensitive drum in the color image forming apparatus according to the present invention shown in FIG. 10, wherein the separation means is indicated by solid lines.
Figure 13:
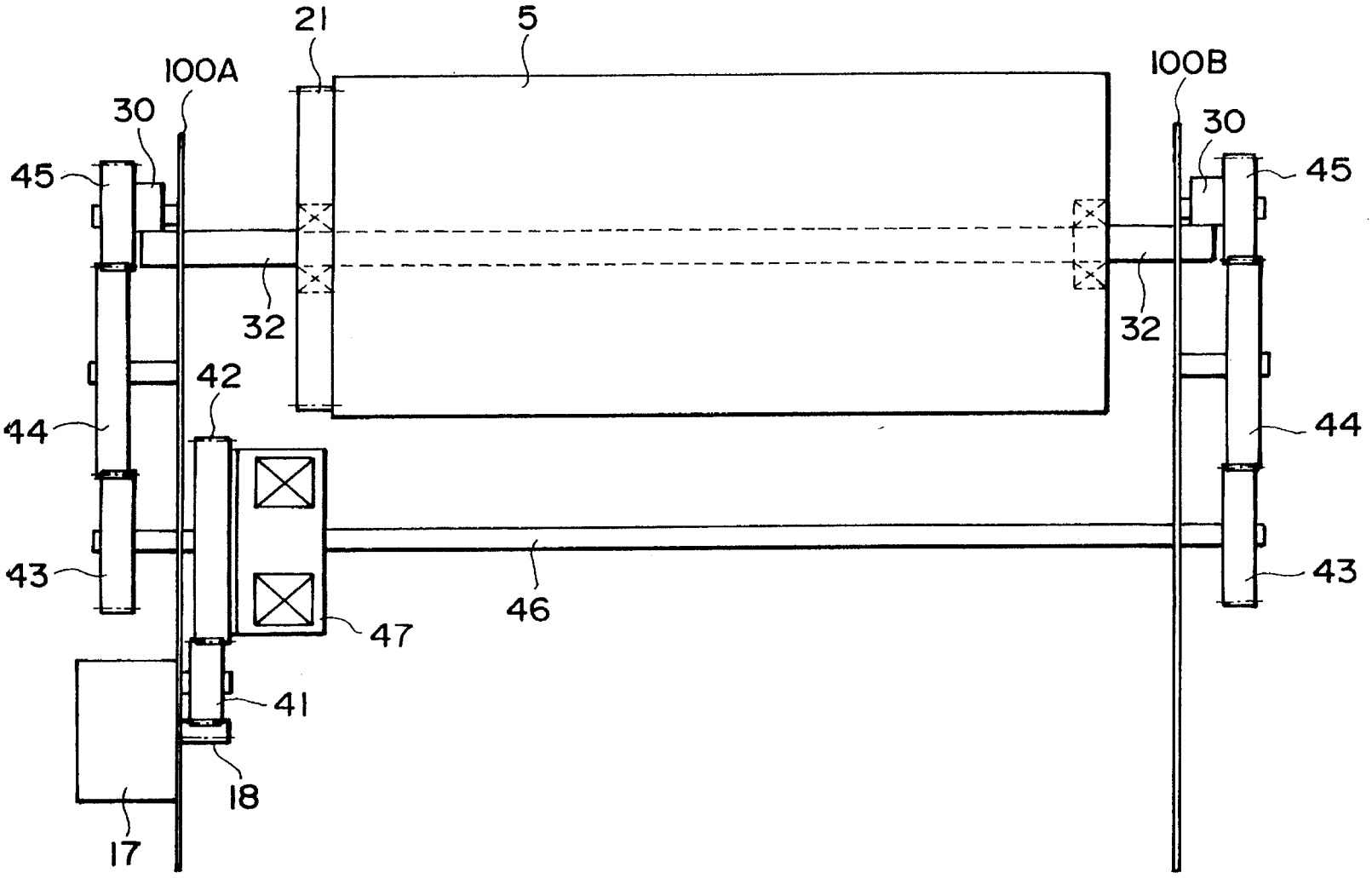
FIG. 13 is a front view of the drive means and the separation means for the transfer drum and the photosensitive drum shown in FIG. 12.

As is more clearly understood when FIGS. 12 and 13 are also referred to, according to this embodiment, the gear 18 of the drive motor 17 engages with a gear 41. The gear 41 engages with a gear 42 rotatably set around a shaft 46, which is in turn rotatably set in the side plates 100 (100A and 100B). Further a rotor of an electromagnetic clutch 47 and a gear 34 are fixed to the shaft 46. The gear 43 engages via a gear 44 with a gear 45, which is coaxial with said eccentric cam 30 and integrally formed therewith so as to rotate with the eccentric cam 30.

In the above-mentioned construction, torque of the motor 17 is transmitted via the gear 18, 19 (19*a* and 19*b*) and 22 to rotate the photosensitive drum 1, as well as via the gear 18, 19 (19*a* and 19*b*), 20 and 21 to rotate the transfer drum 5.

Further, by turning on the electromagnetic clutch, the gear is rotated integrally with the shaft 46, thereby transmitting torque of the drive motor 17 via the gear 18, 41, 42, 43 and 44 to the gear 45. The gear, set integrally with the eccentric cam 30, is shifted by rotation of the eccentric cam 30 so as to separate the transfer drum 5 from the photosensitive drum 1. When the electromagnetic clutch 47 is turned off, transmission of torque to the eccentric cam 30 stops, thereby keeping the transfer drum 5 separate from the photosensitive drum 1. Subsequently, when the electromagnetic clutch 47 is turned on to rotate the eccentric cam 30, the transfer drum 5 can come into contact with the photosensitive drum 1 again.

In the embodiment, since the torsion coil spring 25 presses the gear 20 toward the gear 21 so that the gears engage with each other even when the transfer drum 5 is separated from the photosensitive drum 1, the transfer drum is constantly rotated. Also, in this embodiment, separation distance (d) shown in FIG. 4 is 4 mm as in Embodiment 1.

EMBODIMENT 5

Figure 14:
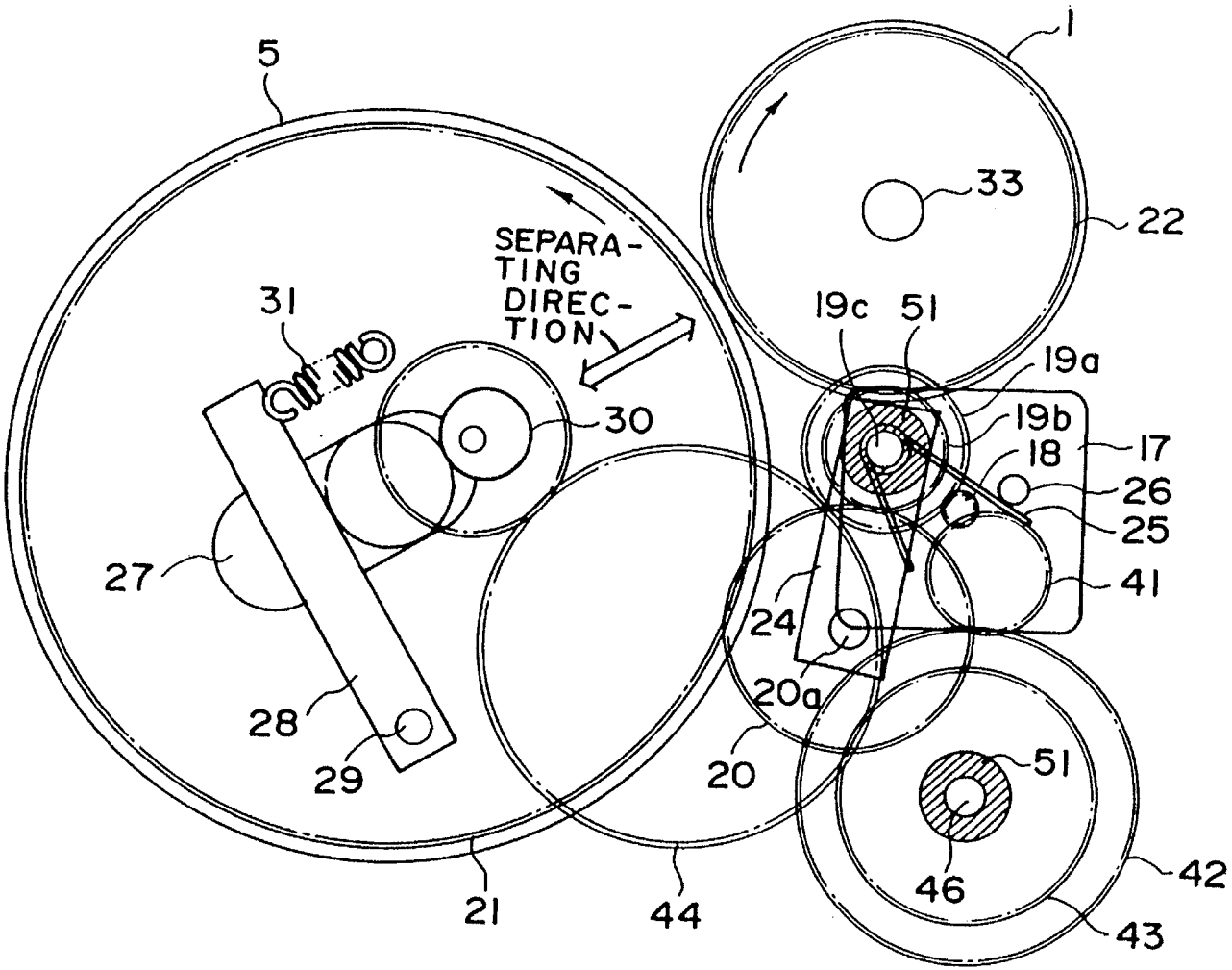
FIG. 14 is a side view of a drive means and a separation means for the transfer drum and the photosensitive drum in the fifth embodiment of the color image forming apparatus according to the present invention, wherein the components are shown as superimposed.
Figure 15:
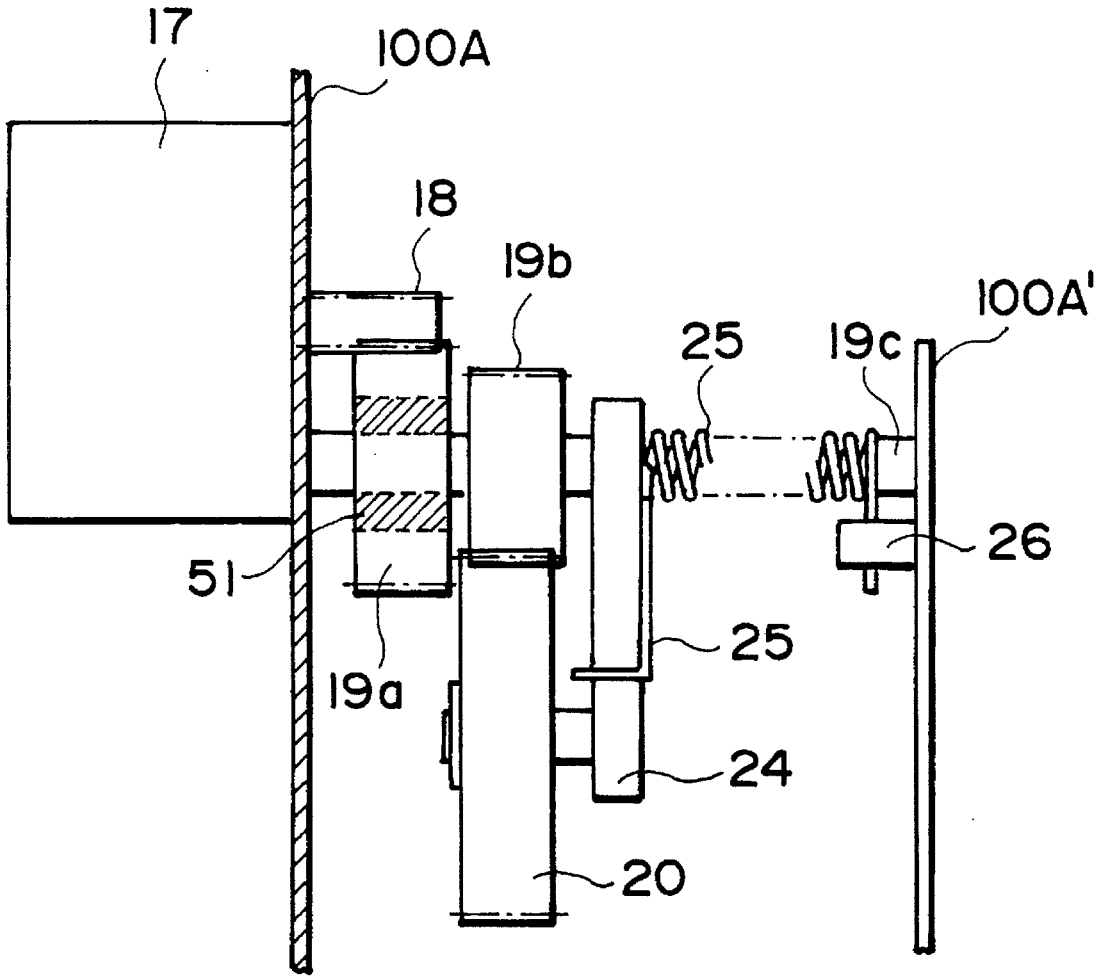
FIG. 15 is a front view of a drive means for the transfer drum and the photosensitive drum shown in FIG. 14.
Figure 16:
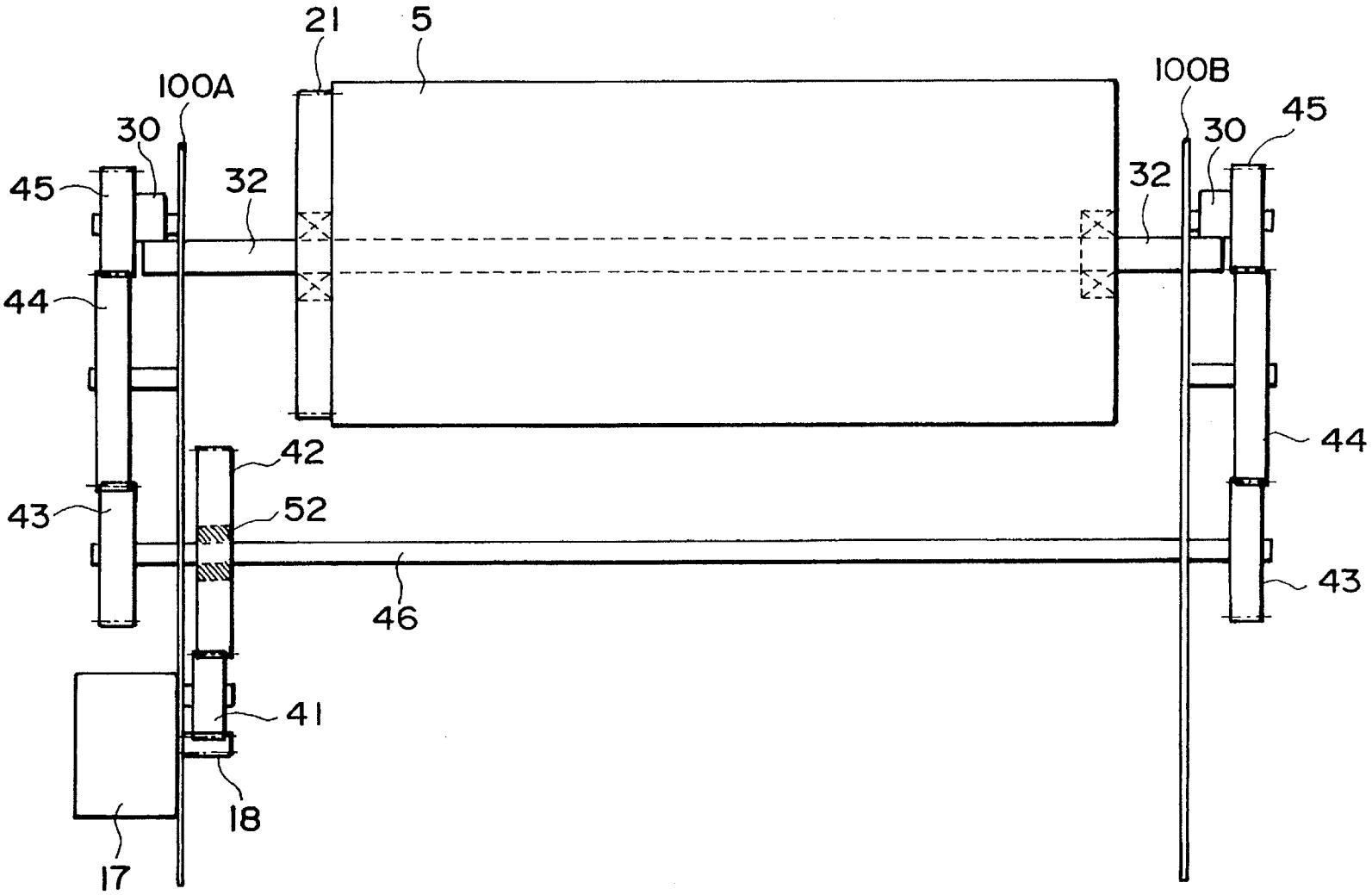
FIG. 16 is a front view of the separation means for the transfer drum and the photosensitive drum shown in FIG. 14.

FIGS. 14 and 15 show the fifth embodiment of the present invention. In this embodiment, the color image forming apparatus according to the present invention is applied to the same color laser printer as in Embodiment 1, wherein the drive means for the transfer drum 5 which separates the transfer drum 5 from the photosensitive drum 1 is the same as that of Embodiment 4 shown in FIGS. 10 to 13. But the electromagnetic clutch 47 in Embodiment 4 is replaced by one-way clutches provided in the gears 19*a* and 42. Therefore, these different components will be mainly described below.

In this embodiment, the larger gear 19*a* and the small gear 19*b*, which constitute the double gear in the drive means in Embodiment 4, are separately formed. The large gear 19*a* is set via a one-way clutch 51 around the shaft 19*c*, while the small gear 19*b* is fixedly set to the shaft 19*c*. Accordingly, the shaft 19*c* is rotatably supported by the side plate 100A and a side plate 100A'. The one-way clutch functions so that the large gear 19*a* rotates with the shaft 19*c* when the gear 19*a* is driven counterclockwise, as shown in FIG. 14, by the gear 18. On the other hand, when the large gear 19*a* is driven clockwise by the gear 18, the one-way clutch functions so that the large gear 19*a* idly runs around the shaft 19*c*.

Further, in this embodiment, as described above, the electromagnetic clutch 47 provided in the drive means in Embodiment 4 is not necessary. Instead, the gear 42 is set via a one-way clutch 52 around the shaft 46. The one-way clutch 52 functions so that the gear 42 idly runs around the shaft 46 when the gear 42 is driven clockwise, as shown in FIG. 14, by the gears 18 and 41. On the other hand, when the gear 42 is driven counterclockwise by the gears 18 and 41, the one-way clutch 52 functions so that the gear 42 rotates integrally with the shaft 46.

Therefore, in this embodiment, when the gear 18 of the drive motor 17 serving as a stepping motor rotates clockwise as shown in FIG. 14, torque of the motor 17 is transmitted via the gears 18, 19*a*, the one-way clutch 51, the gear 19 to the gears 20 and 21 to rotate the transfer drum 5 counterclockwise. At this time, torque of the motor 17 is transmitted via the gear 41 to the gear 42, but to the gear 43 because of the function of the one-way clutch 52. Accordingly, the eccentric cam 30 is not rotated.

On the other hand, when the gear 18 of the drive motor 17 rotates counterclockwise as shown in FIG. 14, torque of the motor 17 is transmitted to the gears 18 and 19*a*, but the gear 19*a* idly runs around the shaft 19*c* because of the one-way clutch 51. Therefore the photosensitive drum 1 and the transfer drum 5 do not rotate. At this time, torque of the motor 17 is transmitted via the gear 41 to the gear 42, and further via the one-way clutch 52 to the gear 43, thereby rotating the eccentric cam 30. The transfer drum 5 is separated from the photosensitive drum 1 by the rotation of the eccentric cam 30.

Subsequently, by reversely driving the motor 17, i.e., clockwise again, the transfer drum 5 and the photosensitive drum 1 can be rotated while the transfer drum 5 is separated. And by driving the motor clockwise again, the transfer drum 5 can come into contact with the photosensitive drum 1 again.

EMBODIMENT 6

Figure 17:
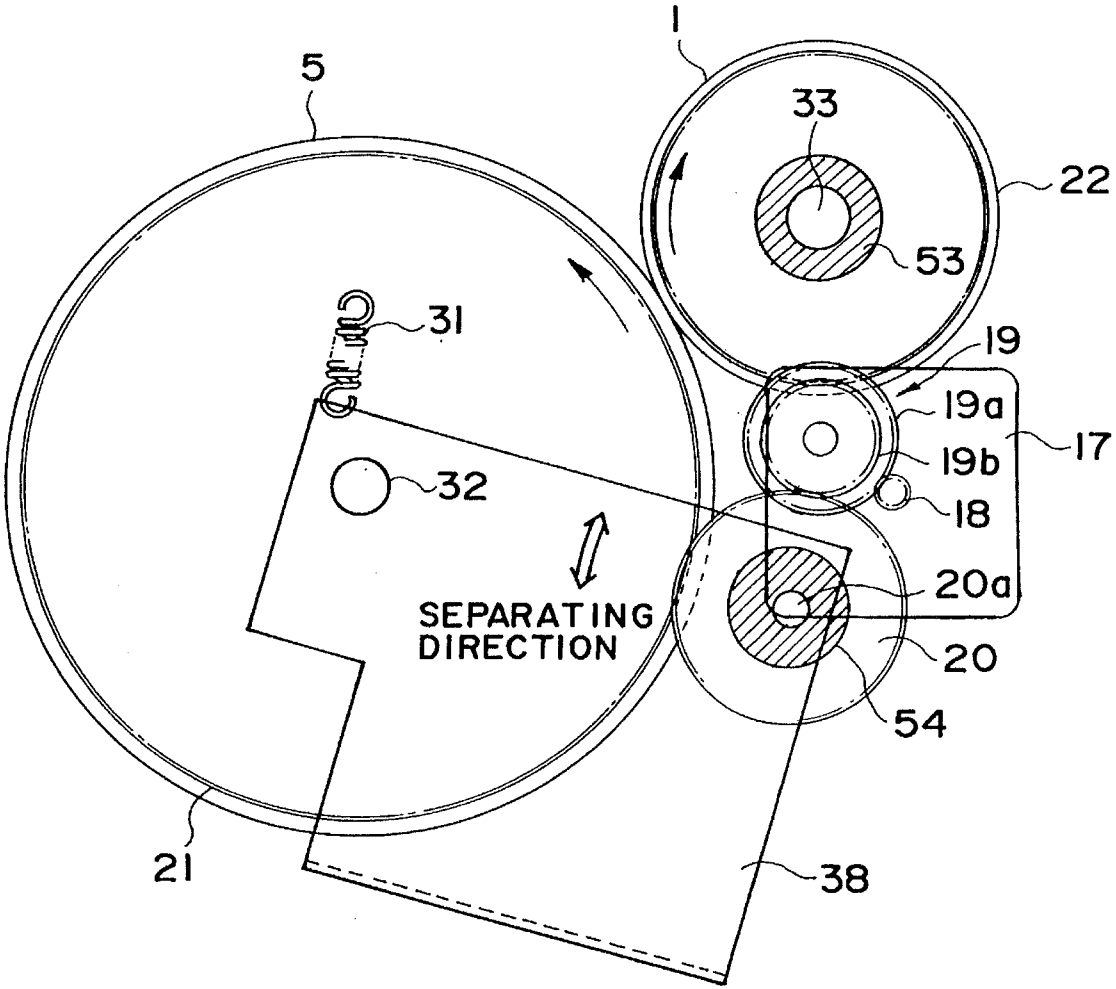
FIG. 17 is a side view of a drive means and a separation means for the transfer drum and the photosensitive drum in the sixth embodiment of the color image forming apparatus according to the present invention, wherein the components are shown as superimposed.
Figure 18:
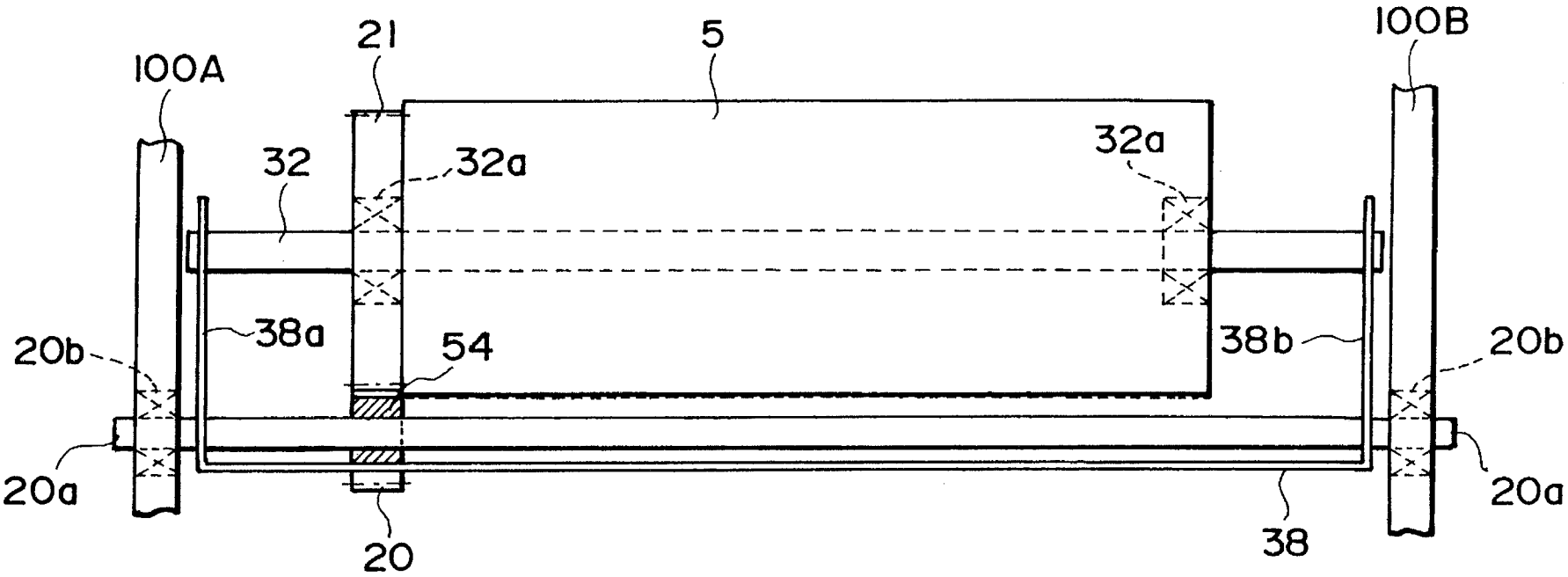
FIG. 18 is a front view of the separation means for the transfer drum and the photosensitive drum shown in FIG. 17.

FIGS. 17 and 18 show the sixth embodiment of the present invention. In this embodiment, the color image forming apparatus according to the present invention is applied to the same color laser printer as in Embodiment 1, where the drive means for the transfer drum 5 which separates the transfer drum 5 from the photosensitive drum 1 is same as that of Embodiment 3 described above and shown in FIGS. 7 and 8. But, in this embodiment, the photosensitive drum 1 is fixedly set around the shaft 33, and the gear 22 is set via a one-way clutch 53 around the shaft 33, and the gear 20 is set via a one-way clutch 54 around the shaft 20*a*. Therefore, these different components will be mainly described below.

In this embodiment, the gear 18 is set around the rotation axis of the motor 17 for driving the transfer drum 5 and the photosensitive drum 18. The gear 18 engages with the large gear 19*a* of the double gear 19, while the small gear 19*b* engages with the gear 20 and the gear 22 which is set via the one-way clutch 53 around the shaft 33. The shaft 33 is rotatably supported by the side plates 100 (100A and 100B), and the photosensitive drum 1 is fixedly set around the shaft 33 and rotates integrally therewith. On the other hand, the gear 20 is set via the one-way clutch 54 around the shaft 20*a* which is rotatably supported via bearings 20*b* by the side plates 100 (100A and 100B). Further, the gear 20 engages with the gear 21 which is set around the flange portion of the transfer drum 5 and rotates integrally with the transfer drum 5. The transfer drum 5 is rotatably set via bearings 32*a* around the rotation axis 32.

Furthermore, in this embodiment, the rotary arm 38 is fixedly set around the shaft 20*a*. The rotary arm 38 has, as a whole, U-like shape. The rotation axis 32 of the transfer drum 5 is fixed to side plates 38*a* and 38*b* of the rotary arm 38. Needless to say, the distance between the rotation axis 32 of the transfer drum 5 and the shaft 20*a*, which is determined by the rotary arm 38, is arranged so that the gears 20 and 21 engage with each other. The rotary arm 32 is pressed clockwise in FIG. 17 by the spring 31 so that the surface of the transfer drum 5 is kept in contact with the surface of the photosensitive drum 1.

Said one-way clutch 53 functions so that the gear 22 engages with the shaft 33 and rotates therewith when the gear 22 rotates clockwise in FIG. 17. And when the gear 22 rotates counterclockwise, the one-way clutch 53 functions so that the gear 22 idly runs around the shaft 33. On the other hand, said one-way clutch 54 functions so that the gear 20 idly runs around the shaft 20*a* when the gear 20 rotates clockwise in FIG. 17. And when the gear 20 rotates counterclockwise, the one-way clutch 54 functions so that the gear 20 engages with the shaft 20*a* and rotates therewith.

Therefore, in the above-mentioned construction, when the drive motor 17 rotates clockwise, torque of the drive motor 17 is transmitted via the gears 18, 19 (19*a* and 19*b*), 22 and the one-way clutch 53 to the photosensitive drum 1, as well as via the gears 18, 19 (19*a* and 19*b*), 20 and 21 to the transfer drum 5, thereby rotating the photosensitive drum 1 and the transfer drum 5. In this case, the one-way clutch 54 idly runs around the shaft 20*a*.

When the drive motor rotates reversely, that is, counterclockwise, the one-way clutch 53 idly runs around the shaft 33 and, accordingly the photosensitive drum 1 stop rotating. In this way, as the photosensitive drum 1 does not rotate reversely, that is, counterclockwise, the cleaning device 9 is protected from being damaged. On the other hand, the one-way clutch 54 engages with the shaft 20*a*, and torque of the drive motor 17 is transmitted via the gears 18, 19 (19*a* and 19*b*) and 20 to the shaft 20*a*, thereby rotating the rotary arm 38 fixedly set around the shaft 20*a*. When the rotary arm 38 is rotated by a predetermined angle, the drive motor 17 stops, and the rotary arm 38 is fixed at its position by a locking mechanism (not shown). In this way, the transfer drum 5 is separated from the photosensitive drum 1.

Further, when the drive motor 17 rotates counterclockwise, the locking mechanism is loosened. Subsequently, when the drive motor 17 rotates clockwise, the one-way clutch 54 is disengaged from the shaft 20*a*, thereby rotating the rotary arm 38 counterclockwise by the spring 31. Thus, the transfer drum 5 comes into contact with the photosensitive drum 1.

In the above-mentioned Embodiments 4, 5 and 6, the same motor transmits torque to the transfer drum 5 and the photosensitive drum 1, and further, the transfer drum 5 is separated from the photosensitive drum 1 also by torque of this motor, thereby minitualizing the apparatus and reducing cost. Incidentally, though in the above description, the transfer drum 5 is shifted and separated from the photosensitive drum 1, the same effect can be obtained by a similar construction in which the photosensitive drum 1 is shifted and separated from the transfer drum 5.

EMBODIMENT 7

Figure 19:
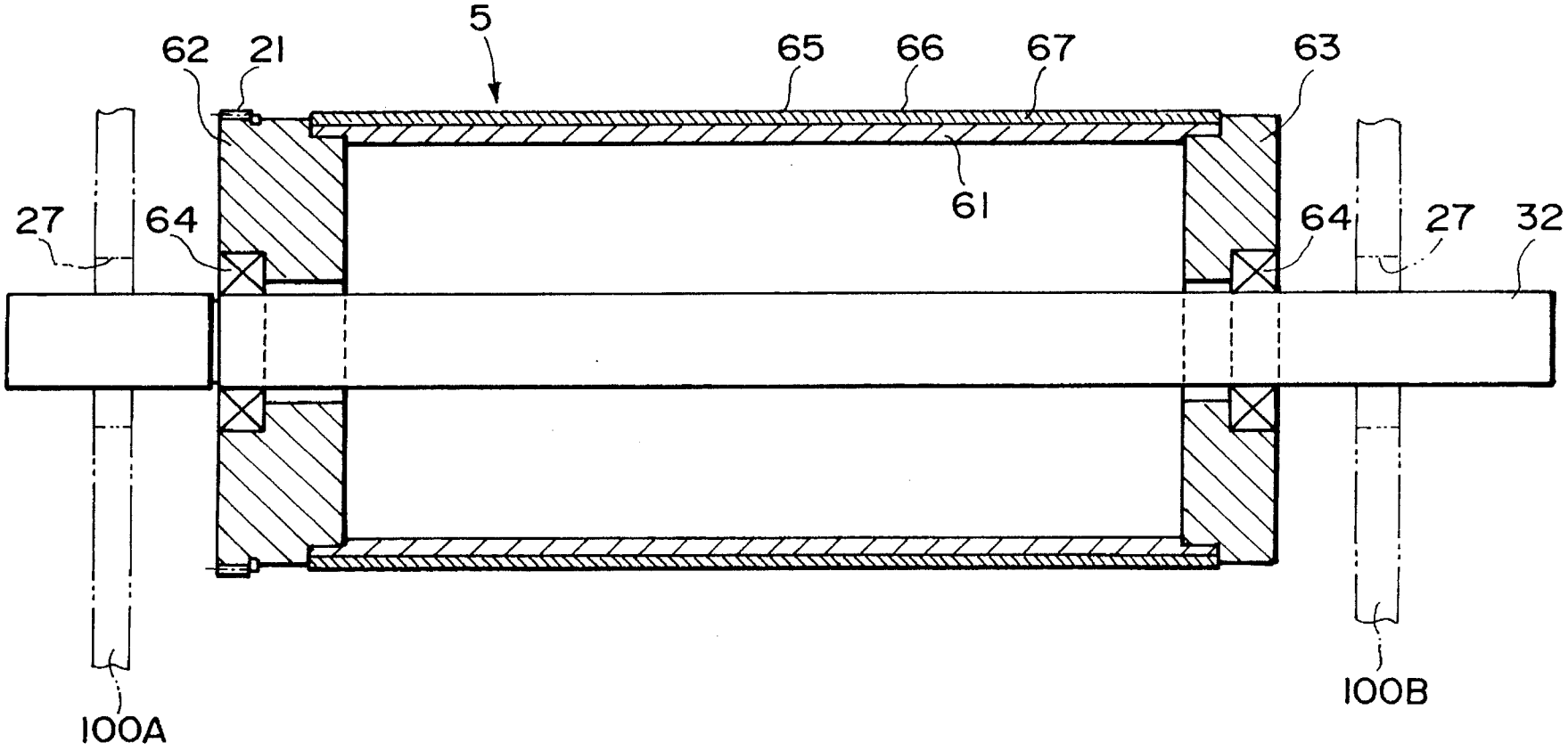
FIG. 19 is a front sectional view of an embodiment of the transfer drum.

FIG. 19 shows an example of the transfer drum 5. As shown in the figure, the transfer drum 5 comprises a cylindrical drum cylinder 61 and flanges 62 and 63 attached to respective ends of the drum cylinder 61, wherein the drum cylinder 61 is rotatably supported via bearings of the flanges 62 and 63 around the spindle 32. On the surface of the drum cylinder, an elastic layer 67, a conductive layer 66 and a dielectric layer 65 are laminated in this order. When this transfer drum 5 comes into contact with the photosensitive drum 1, the elastic layer caves in and forms nip. At the time of the transfer process, voltage with different sign with respect to toner electric charge is applied to the conductive layer 66.

The transfer drum 5 having the above construction forms compression set when concavity does not disappear but remains at one position, for example, when the transfer drum 5 is kept in the stand-by state or unused for a long time. In this case, nonuniformity of concavity between said position and the other portions may often cause transfer failure during the transfer process. So, in this embodiment, the transfer drum 5 is kept separate from the photosensitive drum 1 while the transfer process is not performed.

Figure 20:
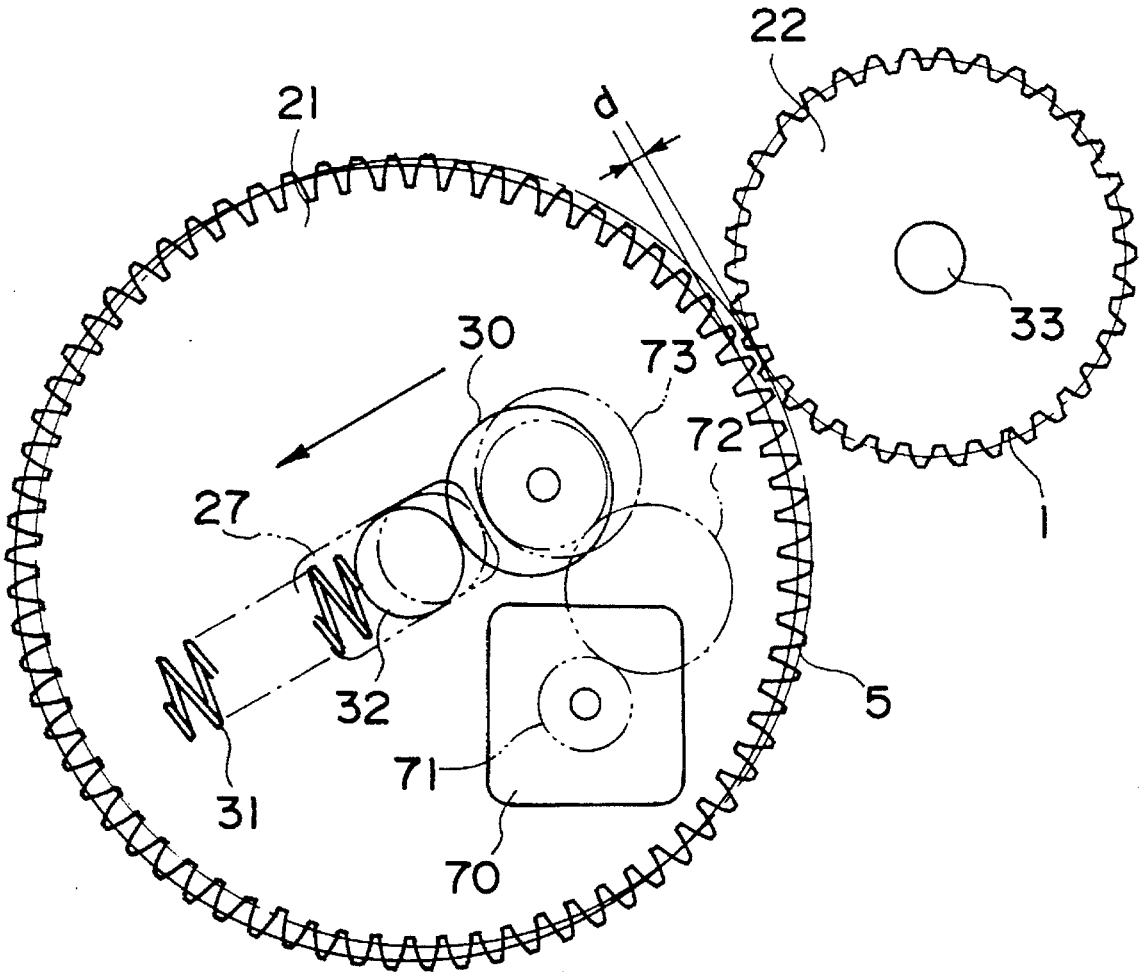
FIG. 20 is a side view of a drive means and a separation means for the transfer drum and the photosensitive drum in the seventh embodiment of the color image forming apparatus according to the present invention.

FIG. 20 shows an example of the drive mechanism for the transfer drum 5. Here, the image forming apparatus according to the present invention is applied to the same color laser printer as in Embodiment 1. This embodiment is characterized by the drive means and separation means for the transfer drum 5 which separate the transfer drum 5 from the photosensitive drum 1. For this reason, only these characteristic components will be described below.

In this embodiment, the gear 21 fixedly provided to an end portion of the transfer drum engages with the gear 22 fixedly set to an end portion of the photosensitive drum 1. Accordingly, torque from a motor (not shown) for driving the photosensitive drum 1 is immediately transmitted to the transfer drum 5, and the transfer drum 5 is rotated.

Further, the rotation axis 32 of the transfer drum 5 is positioned by and set to the side plate 100 (100A and 100B). The side plates 100 have the slits 27 into which the ends of the rotation axis 32 are put. The longitudinal direction of these slit 27 coincides with that from the rotation axis 33 of the photosensitive drum 1 to the rotation axis 32 of the transfer drum 5 so that the rotation axis 32 of the transfer drum 5 shifts in the slits 27 to position the transfer drum at a predetermined position. The rotation axis 32 is pressed against the eccentric cam 30 by the spring 31. Therefore, the amount of rotation of the eccentric cam 30 determines the shifting amount of the transfer drum 5. As in Embodiment 4 shown in FIGS. 10 to 13, a gear 73 is formed integrally and coaxially with the eccentric cam 30. The gear 73 is connected via a gear 72 with an output gear of a drive motor 70 such as a stepping motor. Accordingly, by actuating the drive motor 70, the eccentric cam 30 rotates integrally with the gear 73.

In the above-mentioned construction, until an image formation signal is applied to the color laser printer, the transfer drum is separated from the photosensitive drum 1 and held at a distance (d) therefrom by the eccentric cam 30 driven by the drive motor 70, as indicated by the solid line in FIG. 20. Thus, in this state, the transfer drum 5 is not rotated even if the photosensitive drum has already started rotation.

Subsequently, when the image formation signal starts the image forming operation, at first, the drive motor 70 arranged beside the transfer drum 5 rotates by predetermined pulses so that the eccentric cam 30 makes a half turn by the gears 71, 72 and 73. Thus, the spring 31 which presses the rotation axis 32 of the transfer drum 5 shifts the transfer drum so that the transfer drum 5 comes into contact with the photosensitive drum 1 while pressed by predetermined force. In this way, the gear 21 of the transfer drum 5 engages with the gear 22 of the photosensitive drum 1 and the transfer drum 5 starts rotation. In said state, the image forming process starts. When image formation is finished, the drive motor 70 functions so that the eccentric cam 30 makes another half turn and separates the transfer drum 5 from the photosensitive drum 1. The gear 21 of the transfer drum 5 is disengaged from the gear 22 of the photosensitive drum 1 and the transfer drum stops rotation.

The drive means for shifting the transfer drum 5 with respect to the photosensitive drum 1 and the separation means for separating the transfer drum 5 from the photosensitive drum 1 are not limited to those having said construction, but may have any construction of Embodiments 1 to 6 described before. That is, in any case, the color image forming apparatus which has the separation means for keeping the transfer drum 5 separate from the photosensitive drum 1 when transfer operation is not performed can improve durability of the transfer drum 5.

EMBODIMENT 8

Figure 9:
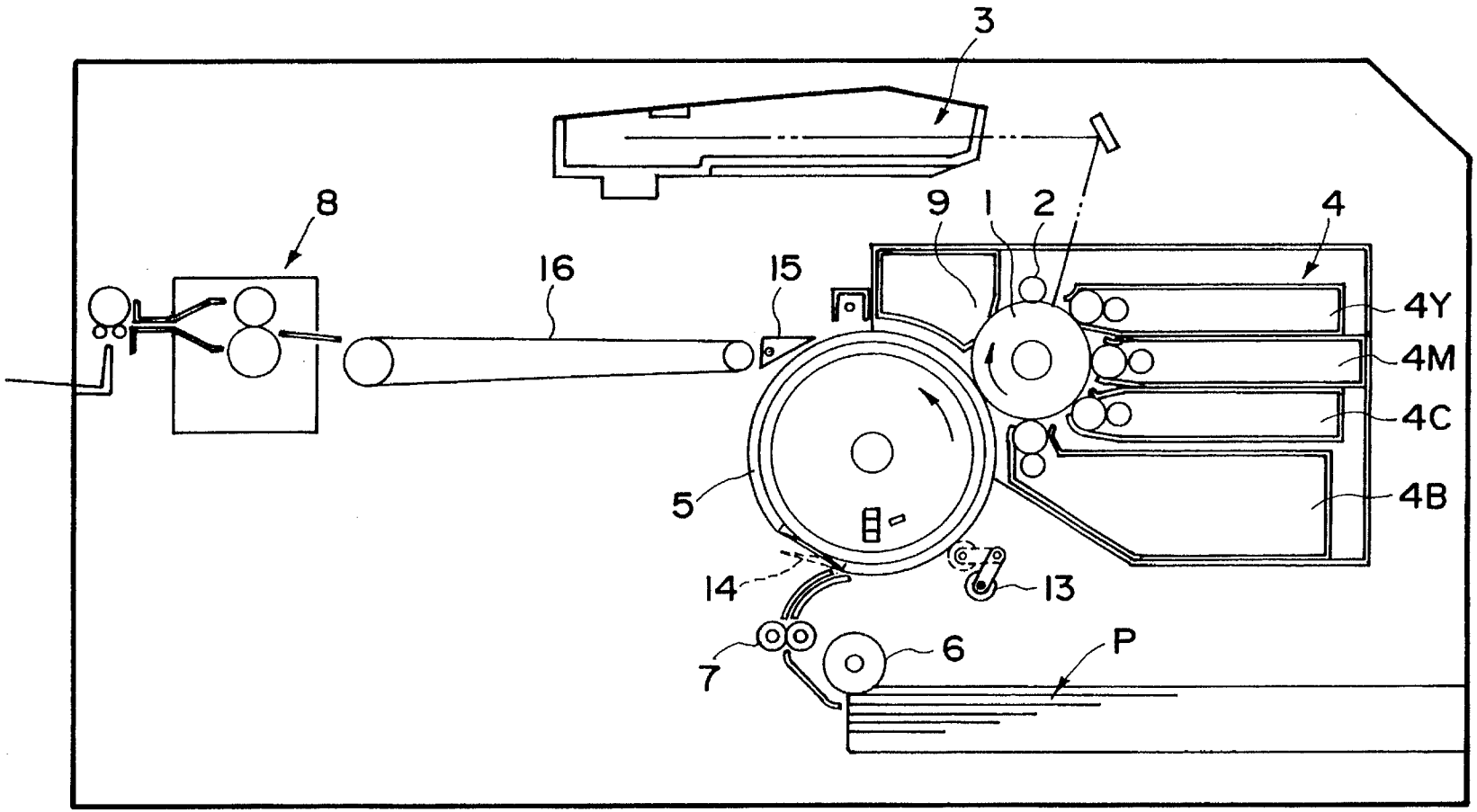
FIG. 9 PRIOR ART
FIG. 9 is a schematic block diagram of a conventional color image forming apparatus.

As described above, as the fixing condition of a normal sheet and that of an OHP sheet, both of which are used as a transfer medium P for the conventional color image forming apparatus, differ from each other, the fixing speed of the OHP sheet should be slower in order to fully heat toner. For this reason, as shown in FIG. 9, conventionally, the convey belt 16 is provided to convey the transfer medium P separated from the transfer drum 5 to the fixing device 8. When the developing and transfer processes are finished and the separated transfer medium P is sent to the convey belt 16, the fixing speed is switched, in case of the OHP sheet, to lower speed for the OHP sheet in order to send the OHP sheet to the fixing device 8.

In order to change the conveying speed after the transfer process as described above, however, it is necessary not to change speed until the rear end of the sheet has completely separated from the transfer position in order to prevent unfixed transferred image from being disturbed. This problem can be solved by providing a mode in which, after the last transfer process, the transfer drum 5 makes another turn to convey the transfer medium P to the fixing device 8. Thus, in this case, the fixing device 8 can be located at the position where, otherwise, the convey belt 16 is provided. In said mode, however, since the image formed on the transfer medium P passes between the photosensitive drum 1 having certain nip and the transfer drum 5, the image may be re-transferred onto the photosensitive drum 1, and the concavity may scratch the surface of the transfer medium P, thereby making the image unclear or disturbed. That is, the problem can not be completely solved.

In this embodiment, however, the transfer drum is separated from the photosensitive drum in the OHP sheet mode in which the transfer medium is further conveyed through the transfer position to the fixing device after the last transfer process. Therefore, the transferred image on the OHP sheet can be conveyed without being touched by the photosensitive drum, and the fixing device can be located close to the transfer drum.

Figure 21:
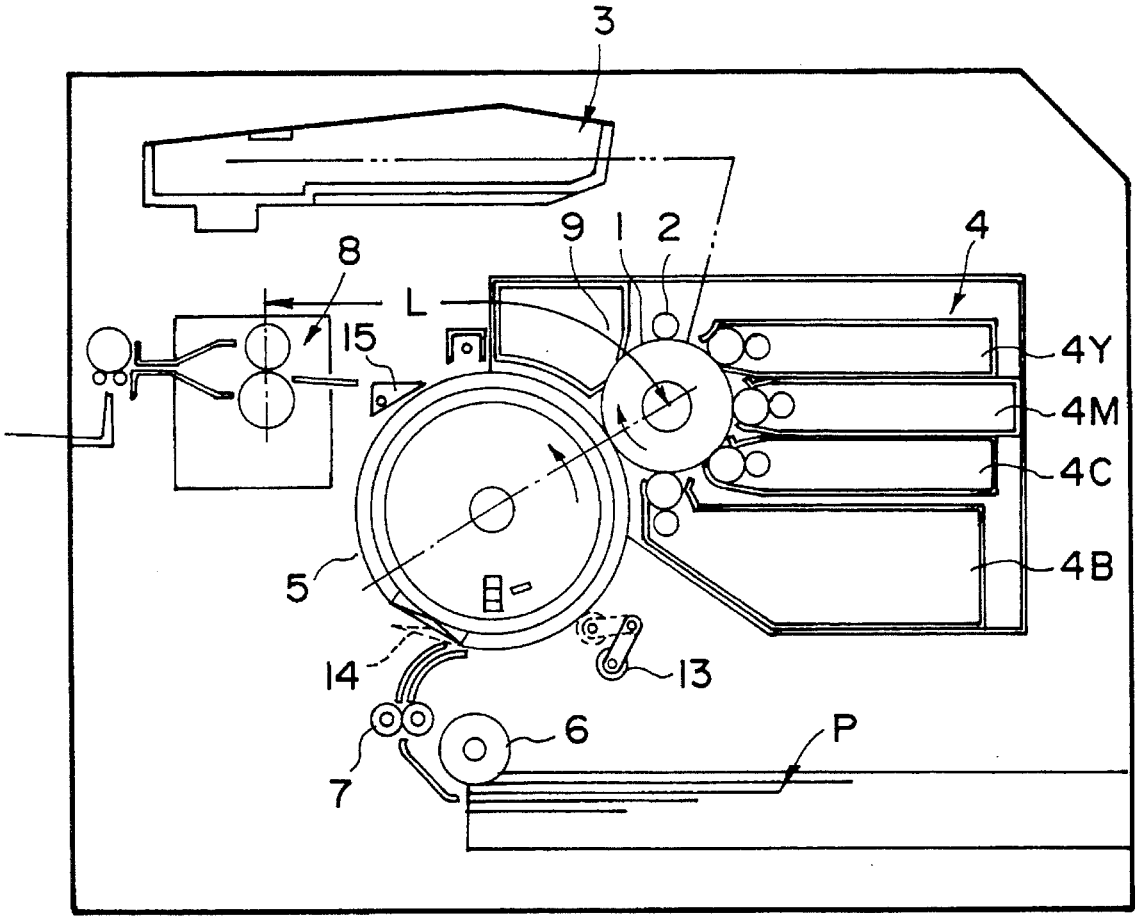
FIG. 21 is a construction view of the electrophotographic type color laser printer in which the color image forming apparatus of the present invention is embodied.

FIG. 21 shows another embodiments of the present invention. In this embodiment, the color image forming apparatus according to the present invention is applied to the same color laser printer as in Embodiment 1 which has the same construction and performs the same functions. Therefore, further description thereof will be omitted.

In this embodiment, the transfer medium P separated one by one from the sheet feed unit by the sheet feed roller 6 is sent at constant timing to the transfer drum 5 by the resist rollers 7. The transfer drum 5 having the nipping means 14 such as a gripper holds the front end of the transfer medium P. The transfer medium P is electrostatically attracted onto the surface of the transfer drum 5 to be conveyed further. The transfer medium P supported and conveyed by the transfer drum 5 passes between the transfer drum 5 and the photosensitive drum 1 (transfer position), where the toner images formed on the photosensitive drum are transferred.

The fixing device 8 is positioned at a distance L: transfer medium conveying distance, from the transfer position, wherein the conveying distance L satisfies $L<L_1$, the maximum length, in the conveying direction, of the transfer medium employed, more specifically, of the OHP sheet.

When a normal sheet is used as the transfer medium P, the fixing device 8 runs at substantially same speed as in the transfer process. After the last transfer process, the front end of the sheet is separated by the separation claw 15 to be led to the fixing device 8. At that time, the rear end portion of the sheet is still being subjected to the transfer process.

On the other hand, when an OHP sheet is used as the transfer medium, a detection means (not shown) detect the OHP sheet as the transfer medium at the time of the sheet feed operation, thereby switching the image formation mode to the OHP sheet mode. Then, the developing and transfer processes start, which are conveyed out at the same speed as in the normal sheet mode. But the fixing device 8 runs at a slower speed than in the normal sheet mode. After the last transfer process, in this OHP sheet mode, the front end of the OHP sheet is not separated by the separation claw 15 but is still supported on the transfer drum 5, which continues rotation until the rear end of the OHP sheet has passed through the transfer position. After the transfer process of the rear end portion of the OHP sheet, the transfer drum 5 is separated from the photosensitive drum 1. Accordingly, the surface of the images on the OHP sheet which is supported on the transfer drum 5 can pass through the transfer position without being touched by the photosensitive drum 1 or other components.

The front end of the OHP sheet after passing through the transfer position is separated by the separation claw 15 and sent to the fixing device 8. As the fixing device 8 is rotated at a lower speed than the transfer drum, the speed of the fixing device 8 is decelerated to be equal to that of the transfer drum 8 immediately before the OHP sheet reaches the fixing device 8. Needless to say, the transfer drum 5 may be decelerated at substantially same time when separation of the transfer medium P is started. Incidentally, when the OHP sheet further passes through the transfer position, it is preferable to apply voltage with different sign with respect to toner electric charge to the transfer drum, as well as to charge the photosensitive drum with same sign with respect to toner electric charge, in order to prevent toner on the OHP sheet from scattering.

The transfer drum 5 can be separated from the photosensitive drum 1 in any construction of the above-mentioned Embodiments 1 to 7.

As described above, in this embodiment, the transfer medium P on which the visible image is transferred is, if necessary, conveyed through the transfer position again after the last transfer process, and at the same time, the transfer drum 5 is separated from the photosensitive drum 1. Thus, the image on the transfer medium P can be conveyed without being touched by the photosensitive drum, and the fixing device 8 can be located close to the transfer drum 5. Therefore, the color image forming apparatus in which the speed of the developing and transfer processes is different from the fixing speed to form the image can be miniaturized.

As described above, said image forming apparatus has the means for separating the transfer drum from the image bearing member such as the photosensitive drum, and further the drive means for surely transmitting its torque to the separated transfer drum. Accordingly, even when a transfer medium such as an OHP sheet whose fixation requires long time is used, the conveyer belt is dispensable and the entire apparatus can be miniaturized. In addition, when it is not necessary to reduce the peripheral velocity of the transfer drum according to the fixation speed of the OHP sheet, and the like, printing time per sheet can be reduced. Further, the drive motor of said drive means can transmit its torque to both the transfer drum and the photosensitive drum at the same time, which further miniaturize the apparatus.

Furthermore, when a transfer medium such as an OHP sheet whose fixation requires long time is used, after the last color image is transferred, the transfer medium is not separated by the separation claw but is still supported on the transfer drum. After the rear end of the transfer medium passes through the transfer position, the transfer drum can be separated from the image bearing member, wherein the image on the transfer medium can be conveyed without being touched by the photosensitive drum and the fixing device can be located close to the transfer drum. Accordingly, the color image forming apparatus in which the speed of the developing and transfer processes is different from the fixing speed to form the image can be miniaturized. Still further, as the transfer drum is kept to be separate from the photosensitive drum by the separation means when the transfer process is not performed, durability of the transfer drum can be improved.

What is claimed is:

1. An image forming apparatus, comprising:

an image bearing member for bearing an image thereon;

a transfer material bearing member for carrying a transfer material to a transfer position repeatedly, said transfer material bearing member carrying the transfer material to the transfer position so that the image on the image bearing member can be transferred onto the transfer material;

fixing means for fixing the transferred image onto the transfer material, said fixing means having a fixing speed which is selectable between a first speed or a second speed which is slower than the first speed; and moving speed control means for controlling a moving speed of said transfer material bearing member, said moving speed control means controlling the moving speed of the transfer material after completion of an image transfer operation so as to correspond the fixing speed, wherein, in the case the second speed is selected as the fixing speed, after completion of image transfer operation said transfer material bearing member re-conveys the transfer material which has an image transferred thereon to the transfer position, and, after completion of image transfer operation and before the transfer material reaches to the fixing position of said fixing means, the moving speed of the transfer material carried by said transfer material bearing member is controlled to correspond to the second speed, and wherein, when the transfer material is being re-conveyed and is being positioned at the transfer position, the transfer material carried on said transfer material bearing member is being separated from said image bearing member.

2. An image forming apparatus according to claim 1, wherein said transfer material bearing member is shiftable to a first peripheral speed in which the image is transferred to the transfer material, or to a second peripheral speed which is slower than the first peripheral speed and substantially equal to the second speed, and wherein when the second speed is selected as the fixing speed, after completion of the image transfer operation and before the transfer material reaches to the fixing position of said fixing means, the moving speed of said transfer material bearing member is changed from the first peripheral speed to the second peripheral speed.

3. An image forming apparatus according to claim 2, wherein, when the second speed is selected as the fixing speed, the shifting speed of the transfer medium bearing member during the transfer process is substantially equal to the first speed.

4. An image forming apparatus according to claim 3, in both of cases where the first speed is selected and the second speed is selected as the fixing speed, the moving speed of said transfer material bearing member is substantially equal to the first speed during the transfer operation.

5. An image forming apparatus according to claim 1, wherein the image forming apparatus can select the first mode in which a normal sheet is used as the transfer medium or a second mode in which a special sheet is used as the transfer medium; when said first mode is selected, the first speed is selected as the fixing speed; and, when said second mode is selected, the second speed is selected as the fixing speed.

6. An image forming apparatus according to claim 5, wherein said second mode is selected when a resin sheet is used as the transfer medium.

7. An image forming apparatus according to claim 5, wherein distance along the transfer medium conveying path, from the separation position at which the transfer medium is separated from the transfer medium bearing member to the fixing position at which the fixing device executes fixation, is shorter than the maximum length, along the transfer medium conveying path, of the special sheet available for the image forming apparatus.

8. An image forming apparatus according to claim 5, wherein distance along the transfer medium conveying path from said transfer position to said fixing position of the fixing means is shorter than the maximum length, along the transfer medium conveying path, of the special sheet available for the image forming apparatus.

9. An image forming apparatus according to claim 5, wherein when the second speed is selected as the fixing speed, said transfer material bearing member has a third speed which is used during the image transfer operation, and is changed to a fourth speed slower than the third speed after completion of the image transfer operation and before the transfer material reaches the fixing position of said fixing means.

10. An image forming apparatus according to claim 5, wherein, when the first speed is selected as the fixing speed, said transfer material bearing member does not re-convey the transfer material on which the image has been transferred after completion of the image transfer operation.

11. An image forming apparatus according to claim 1, wherein said transfer material bearing member which is rotating is separated away from said image bearing member during the transfer material is re-conveyed to the transfer position.

12. An image forming apparatus according to claim 11, wherein the image forming apparatus has a common drive source which separates the transfer medium bearing member from the image bearing member as well as rotates the transfer medium bearing member and the image bearing member.

13. An image forming apparatus according to claim 1, wherein a plurality of color toner images are formed on the image bearing member and the toner images are in turn transferred and superimposed onto the transfer medium borne on the transfer medium bearing member.

14. An image forming apparatus according to claim 1, wherein, after fixation by the fixing device, a full-color toner image can be formed on the transfer medium.

15. An image forming apparatus according to claim 1, wherein, when the second speed is selected as the fixing speed, said transfer material bearing member has a third speed which is used during the image transfer operation, and is changed to a fourth speed slower than the third speed after completion of the image transfer operation and before the transfer material reaches the fixing position of said fixing means.

16. An image forming apparatus according to claim 1, wherein, when the first speed is selected as the fixing speed, said transfer material bearing member does not re-convey the transfer material to the transfer position after completion of the image transfer operation.

17. An image apparatus comprising:

an image bearing member for bearing an image thereon;

a transfer material bearing member for conveying a transfer material to a transfer position repeatedly, the image on said image bearing member being transferred to the transfer material conveyed by said transfer material bearing member at the transfer position, said transfer material bearing member being movable in a first peripheral speed where the image is transferred onto the transfer material, or in a second peripheral speed which is slower than the first peripheral speed; and fixing means for fixing the image on the transfer material, said fixing means having a fixing speed which is selectable between a first speed or a second speed which is slower than the first speed;

wherein, in the case the second speed is selected as the fixing speed, after completion of image transfer operation said transfer material bearing member re-conveys the transfer material which has an image transferred thereon to the transfer position, and, after completion of image transfer operation and before the transfer material reaches to the fixing position of said fixing means, the moving speed of said transfer material bearing member is changed from the first peripheral speed to the second peripheral speed, and wherein, when the transfer material is being re-conveyed to the transfer position material born by the transfer material bearing member is separated away from said image bearing member.

18. An image forming apparatus according to claim 17, wherein the first speed is substantially equal to the first peripheral speed, and the second speed is substantially equal to the second peripheral speed.

19. An image forming apparatus according to claim 17, wherein distance from a separating position where the transfer material is separated from said transfer material bearing member to the fixing position by said fixing means along a convey path of the transfer material is shorter than a maximum length of the transfer material to be used.

20. An image forming apparatus according to claim 17, wherein a plurality of color toner images are formed on the image bearing member and the toner images are in turn transferred and superimposed onto the transfer material carried on the transfer material bearing member.

21. An image forming apparatus according to claim 20, wherein, after fixation by the fixing device, a full-color toner image can be formed on the transfer material.

22. An image forming apparatus according to claim 17, wherein in the case the first speed is selected as the fixing speed, said transfer material bearing member maintains the first peripheral speed and does not reconvey the transfer material to the transfer position after the image transfer operation is completed.

23. An image forming apparatus according to claim 22, wherein the image forming apparatus can select the first mode in which a normal sheet is used as the transfer medium or a second mode in which a special sheet is used as the transfer medium, and when said first mode is selected, the first speed is selected as the fixing speed and, when said second mode is selected, the second speed is selected as the fixing speed.

* * * * *

UNITED STATES PATENT AND TRADEMARK OFFICE

CERTIFICATE OF CORRECTION

PATENT NO. : 5,623,333

DATED : April 22, 1997

INVENTORS : Toshiki Nagase, et al.

It is certified that error appears in the above-identified patent and that said Letters Patent is hereby corrected as shown below:

ON THE COVER PAGE:

Under [57] Abstract, line 9, "conveyed" should read --conveyor--.

COLUMN 8

Line 17, "gear" should read --gears--; and
Line 18, "gear" should read --gears--.

COLUMN 10

Line 34, "stop" should read --stops--.

COLUMN 12

Line 64, "embodiments" should read --embodiment--.

COLUMN 14

Line 56, "correspond" should read --correspond to--.

UNITED STATES PATENT AND TRADEMARK OFFICE

CERTIFICATE OF CORRECTION

PATENT NO. : 5,623,333

DATED : April 22, 1997

INVENTORS : Toshiki Nagase, et al.

It is certified that error appears in the above-identified patent and that said Letters Patent is hereby corrected as shown below:

COLUMN 16

Line 53, "to" should be deleted; and
Line 59, "position material born" should read --position, the transfer material born--.

Signed and Sealed this

Second Day of December,1997

*Attest:*

*Attesting Officer*

BRUCE LEHMAN

*Commissioner of Patents and Trademarks*